US007354136B2

(12) United States Patent
Oishi

(10) Patent No.: US 7,354,136 B2
(45) Date of Patent: Apr. 8, 2008

(54) INKJET HEAD

(75) Inventor: Tatsuo Oishi, Nagoya (JP)

(73) Assignee: Brother Koygo Kabushiki Kaisha, Nagoya (JP)

( * ) Notice: Subject to any disclaimer, the term of this patent is extended or adjusted under 35 U.S.C. 154(b) by 269 days.

(21) Appl. No.: 11/090,641

(22) Filed: Mar. 28, 2005

(65) Prior Publication Data

US 2005/0219312 A1 Oct. 6, 2005

(30) Foreign Application Priority Data

Mar. 30, 2004 (JP) ..... 2004-098255

(51) Int. Cl.
*B41J 2/15* (2006.01)

(52) U.S. Cl. ..... 347/40; 347/68

(58) Field of Classification Search ..... 347/43, 347/68–72

See application file for complete search history.

(56) References Cited

U.S. PATENT DOCUMENTS

| | | | | |
|---|---|---|---|---|
| 6,390,597 | B1 | 5/2002 | Fujimoto et al. | |
| 6,488,355 | B2 | 12/2002 | Nakamura et al. | |
| 6,986,564 | B2 * | 1/2006 | Matsuo et al. | 347/68 |
| 7,055,936 | B2 * | 6/2006 | Imai et al. | 347/58 |
| 2002/0027579 | A1 * | 3/2002 | Matsuo et al. | 347/68 |
| 2002/0080215 | A1 | 6/2002 | Sakaida et al. | |
| 2003/0020787 | A1 * | 1/2003 | Nakamura et al. | 347/57 |
| 2004/0130604 | A1 * | 7/2004 | Watanabe et al. | 347/71 |
| 2005/0185019 | A1 * | 8/2005 | Goto et al. | 347/47 |

FOREIGN PATENT DOCUMENTS

| | | |
|---|---|---|
| EP | 0 773 108 A2 | 5/1997 |
| JP | 07-276630 | 10/1995 |
| JP | 2001-334661 | 12/2001 |
| JP | 2002-273878 | 9/2002 |
| JP | 2003-118109 | 4/2003 |
| JP | 2003-237078 | 8/2003 |
| JP | A 2003-237078 | 8/2003 |

* cited by examiner

*Primary Examiner*—Matthew Luu
*Assistant Examiner*—Joshua M Dubnow
(74) *Attorney, Agent, or Firm*—Oliff & Berridge, PLC

(57) ABSTRACT

In an inkjet head, 4n rows (n: a natural number) parallel to each other are formed in each of which nozzles are arranged on an ink ejection face of the inkjet head in one direction. All the nozzles constituting each row are arranged such that projection points of the nozzles obtained by projecting the nozzles on an imaginary straight line extending parallel to each row, from a direction parallel to a plane including the rows, and perpendicular to each row, are arranged on the imaginary straight line at regular intervals. The nozzles are arranged in a cycle corresponding to a distance between the projection points at both ends of 4n+1 projection points arranged on the imaginary straight line. The total of products each obtained by a peak value of a modulation transfer function defined by the arrangement of the nozzles, multiplied by a value of a visual transfer function at a spatial frequency corresponding to the peak value of the modulation transfer function, is not more than 0.10.

8 Claims, 20 Drawing Sheets

FIG. 20

| | | | | | | | | | | | | | | | | | | | | | | | |
|---|---|---|---|---|---|---|---|---|---|---|---|---|---|---|---|---|---|---|---|---|---|---|---|
| 1 | 1 | 1 | 1 | 1 | 1 | 2 | 2 | 2 | 2 | 2 | 2 | 3 | 3 | 3 | 3 | 3 | 3 | 4 | 4 | 4 | 4 | 4 | 4 |
| 5 | 5 | 9 | 9 | 13 | 13 | 6 | 6 | 10 | 10 | 14 | 14 | 7 | 7 | 11 | 11 | 15 | 15 | 8 | 8 | 12 | 12 | 16 | 16 |
| 9 | 13 | 5 | 13 | 5 | 9 | 10 | 14 | 6 | 14 | 6 | 10 | 11 | 15 | 7 | 15 | 7 | 11 | 12 | 16 | 8 | 16 | 8 | 12 |
| 13 | 9 | 13 | 5 | 9 | 5 | 14 | 10 | 14 | 16 | 10 | 6 | 15 | 11 | 15 | 7 | 11 | 7 | 16 | 12 | 16 | 8 | 12 | 8 |
| 3 | 3 | 3 | 3 | 3 | 3 | 4 | 4 | 4 | 4 | 4 | 4 | 5 | 5 | 5 | 5 | 5 | 5 | 6 | 6 | 6 | 6 | 6 | 6 |
| 7 | 7 | 11 | 11 | 15 | 15 | 8 | 8 | 12 | 12 | 16 | 16 | 9 | 9 | 13 | 13 | 1 | 1 | 10 | 10 | 14 | 14 | 2 | 2 |
| 11 | 15 | 7 | 15 | 7 | 11 | 12 | 16 | 8 | 16 | 8 | 12 | 13 | 1 | 9 | 1 | 9 | 13 | 14 | 2 | 10 | 2 | 10 | 14 |
| 15 | 11 | 15 | 7 | 11 | 7 | 16 | 12 | 16 | 8 | 12 | 8 | 1 | 13 | 1 | 9 | 13 | 9 | 2 | 14 | 2 | 10 | 14 | 10 |
| 2 | 6 | 2 | 10 | 6 | 10 | 1 | 5 | 1 | 9 | 5 | 9 | 16 | 4 | 16 | 8 | 4 | 8 | 15 | 3 | 15 | 7 | 3 | 7 |
| 6 | 2 | 10 | 2 | 10 | 6 | 5 | 1 | 9 | 1 | 9 | 5 | 4 | 16 | 8 | 16 | 8 | 4 | 3 | 15 | 7 | 15 | 7 | 3 |
| 10 | 10 | 6 | 6 | 2 | 2 | 9 | 9 | 5 | 5 | 1 | 1 | 8 | 8 | 4 | 4 | 16 | 16 | 7 | 7 | 3 | 3 | 15 | 15 |
| 14 | 14 | 14 | 14 | 14 | 14 | 13 | 13 | 13 | 13 | 13 | 13 | 12 | 12 | 12 | 12 | 12 | 12 | 11 | 11 | 11 | 11 | 11 | 11 |
| 4 | 8 | 4 | 12 | 8 | 12 | 3 | 7 | 3 | 11 | 7 | 11 | 2 | 6 | 2 | 10 | 6 | 10 | 1 | 5 | 1 | 9 | 5 | 9 |
| 8 | 4 | 12 | 4 | 12 | 8 | 7 | 3 | 11 | 3 | 11 | 7 | 6 | 2 | 10 | 2 | 10 | 6 | 5 | 1 | 9 | 1 | 9 | 5 |
| 12 | 12 | 8 | 8 | 4 | 4 | 11 | 11 | 7 | 7 | 3 | 3 | 10 | 10 | 6 | 6 | 2 | 2 | 9 | 9 | 5 | 5 | 1 | 1 |
| 16 | 16 | 16 | 16 | 16 | 16 | 15 | 15 | 15 | 15 | 15 | 15 | 14 | 14 | 14 | 14 | 14 | 14 | 13 | 13 | 13 | 13 | 13 | 13 |

FIG. 10

FIG. 13

| | | | | | | | | | | | | | | | | | | | | | | | |
|---|---|---|---|---|---|---|---|---|---|---|---|---|---|---|---|---|---|---|---|---|---|---|---|
| 5 | 5 | 5 | 5 | 5 | 5 | 6 | 6 | 6 | 6 | 6 | 6 | 7 | 7 | 7 | 7 | 7 | 7 | 8 | 8 | 8 | 8 | 8 | 8 |
| 1 | 1 | 9 | 9 | 13 | 13 | 2 | 2 | 10 | 10 | 14 | 14 | 3 | 3 | 11 | 11 | 15 | 15 | 4 | 4 | 12 | 12 | 16 | 16 |
| 9 | 13 | 1 | 13 | 1 | 9 | 10 | 14 | 2 | 14 | 2 | 10 | 11 | 15 | 3 | 15 | 3 | 11 | 12 | 16 | 4 | 16 | 4 | 12 |
| 13 | 9 | 13 | 1 | 9 | 1 | 14 | 10 | 14 | 2 | 10 | 2 | 15 | 11 | 15 | 3 | 11 | 3 | 16 | 12 | 16 | 4 | 12 | 4 |
| 7 | 7 | 7 | 7 | 7 | 7 | 8 | 8 | 8 | 8 | 8 | 8 | 9 | 9 | 9 | 9 | 9 | 9 | 10 | 10 | 10 | 10 | 10 | 10 |
| 3 | 3 | 11 | 11 | 15 | 15 | 4 | 4 | 12 | 12 | 16 | 16 | 5 | 5 | 13 | 13 | 1 | 1 | 6 | 6 | 14 | 14 | 2 | 2 |
| 11 | 15 | 3 | 15 | 3 | 11 | 12 | 16 | 4 | 16 | 4 | 12 | 13 | 1 | 5 | 1 | 5 | 13 | 14 | 2 | 6 | 2 | 6 | 14 |
| 15 | 11 | 15 | 3 | 11 | 3 | 16 | 12 | 16 | 4 | 12 | 4 | 0 | 13 | 1 | 5 | 13 | 5 | 2 | 14 | 2 | 6 | 14 | 6 |
| 2 | 6 | 2 | 14 | 6 | 14 | 1 | 5 | 1 | 13 | 5 | 13 | 16 | 4 | 16 | 12 | 4 | 12 | 15 | 3 | 15 | 11 | 3 | 11 |
| 6 | 2 | 14 | 2 | 14 | 6 | 5 | 1 | 13 | 1 | 13 | 5 | 4 | 16 | 12 | 16 | 12 | 4 | 3 | 15 | 11 | 15 | 11 | 3 |
| 14 | 14 | 6 | 6 | 2 | 2 | 13 | 13 | 5 | 5 | 1 | 1 | 12 | 12 | 4 | 4 | 16 | 16 | 11 | 11 | 3 | 3 | 15 | 15 |
| 10 | 10 | 10 | 10 | 10 | 10 | 9 | 9 | 9 | 9 | 9 | 9 | 8 | 8 | 8 | 8 | 8 | 8 | 7 | 7 | 7 | 7 | 7 | 7 |
| 4 | 8 | 4 | 16 | 8 | 16 | 3 | 7 | 3 | 15 | 7 | 15 | 2 | 6 | 2 | 14 | 6 | 14 | 1 | 5 | 1 | 13 | 5 | 13 |
| 8 | 4 | 16 | 4 | 16 | 8 | 7 | 3 | 15 | 3 | 15 | 7 | 6 | 2 | 14 | 2 | 14 | 6 | 5 | 1 | 13 | 1 | 13 | 5 |
| 16 | 16 | 8 | 8 | 4 | 4 | 15 | 15 | 7 | 7 | 3 | 3 | 14 | 14 | 6 | 6 | 2 | 2 | 13 | 13 | 5 | 5 | 1 | 1 |
| 12 | 12 | 12 | 12 | 12 | 12 | 11 | 11 | 11 | 11 | 11 | 11 | 10 | 10 | 10 | 10 | 10 | 10 | 9 | 9 | 9 | 9 | 9 | 9 |

FIG. 16

INKJET HEAD

BACKGROUND OF THE INVENTION

1. Field of the Invention

The present invention relates to an inkjet head in which pressure chambers are arranged in a matrix.

2. Description of Related Art

JP-A-2003-237078 discloses an inkjet head in which a large number of pressure chambers are arranged in a matrix. Upper section of FIG. 21 shows a schematic view of an arrangement of nozzles of inkjet head used as a line head. In the inkjet head of upper section of FIG. 21, each of belt-like regions R defined by a large number of straight lines extending in a paper conveyance direction, i.e., a sub scanning direction, includes therein sixteen nozzles 108. The sixteen nozzles 108 differ from one another in coordinate value in a head longitudinal direction, i.e., a main scanning direction, and coordinate value in the paper conveyance direction, i.e., the sub scanning direction. Sixteen points obtained by projecting the sixteen nozzles 108 from the sub scanning direction on an imaginary straight line extending in the main scanning direction, are arranged at regular intervals corresponding to resolution of print. When the nozzles are numbered by (1) to (16) in order from the left of the arrangement of the corresponding projection points, the sixteen nozzles 108 are arranged in the order of (1), (9), (5), (13), (2), (10), (6), (14), (3), (11), (7), (15), (4), (12), (8), and (16) from the lower side. When each belt-like region R is equally divided into four sub regions r1, r2, r3, and r4 by straight lines extending in the sub scanning direction, each sub region includes therein four nozzles 108 arranged on a straight line. Any belt-like region R has the same arrangement of sixteen nozzles 108.

In this inkjet head, when ink is ejected from the nozzles 108 in order at short ejection intervals onto a paper being conveyed, as shown in middle section of FIG. 21, a large number of straight lines can be printed that extend in the sub scanning direction and are arranged at the same regular intervals as the intervals between the above-described projection points. Because each interval between the straight lines is narrow, the region in which the large number of straight lines have been printed can be practically observed as if it is a solid region.

In the inkjet head disclosed in JP-A-2003-237078, as shown in upper section of FIG. 21, a nozzle (1) belonging to a belt-like region R is at a very long distance in the sub scanning direction from a nozzle (16) belonging to the left neighboring belt-like region R. Therefore, if a large number of straight lines as shown in middle section of FIG. 21 are printed with the inkjet head having been attached at a somewhat incorrect angle, as shown in lower section of FIG. 21, the interval between the straight line formed by ink ejected from the nozzle (1) and the straight line formed by ink ejected from the nozzle (16) may be wider than the intervals between the other straight lines. As a result, periodic white stripes 101, called banding, appear on the print. This gives an observer an uncomfortable feeling.

To avoid banding, the inkjet head must be attached to the main body of a printer with very high accuracy. However, a process for attaching the inkjet head with high accuracy may cause complication of the manufacture process of the printer and an increase in cost.

SUMMARY OF THE INVENTION

An object of the present invention is to provide an inkjet head capable of obtaining good print results even without requiring the attachment of the inkjet head with high accuracy.

According to an aspect of the present invention, an inkjet head comprises a plurality of nozzles for ejecting ink arranged on an ink ejection face of the inkjet head in 4n rows (n: a natural number) extending parallel to each other in one direction such that projection points of the nozzles obtained by projecting all the nozzles constituting the 4n rows on an imaginary straight line extending in the one direction, from a direction parallel to a plane including therein the 4n rows, and perpendicular to each row, are arranged on the imaginary straight line at regular intervals. The plurality of nozzles are arranged in a cycle corresponding to a distance between the projection points at both ends of 4n+1 projection points arranged on the imaginary straight line. The total of products each obtained by a peak value of a modulation transfer function defined by the arrangement of the plurality of nozzles, multiplied by a value of a visual transfer function at a spatial frequency corresponding to the peak value of the modulation transfer function, is not more than 0.10.

The visual transfer function (hereinafter may be simply referred to as VTF) is a function representing the sensitivity of human visual recognition to spatial frequency. Also in the field of inkjet type hard copy, it is for evaluation with taking mental factor of human, who is apt to sensuously judge the quality of print, into consideration of a quantitative factor of printing, and thus it is an objective evaluation standard of the quality of print, in which individual variation has been reduced. VTF is experimentally obtained by carrying out sampling to a large number of humans. VTF is given as a curve that the value of the function is the maximum at a specific value of the spatial frequency and reduces as the spatial frequency gets apart from its specific value. For example, in evaluating the problem of banding by using VTF, when the value of the spatial frequency corresponding to the maximum value of VTF is represented by N, the human sensitivity to banding is the highest at N of the spatial frequency. The sensitivity to banding lowers as the value of the spatial frequency decreases from N or increases from N. On the other hand, the modulation transfer function (hereinafter may be simply referred to as MTF) is a standardization of the absolute value of a complex number obtained as a result of Fourier transformation of a nozzle arrangement with respect to spatial frequency. A peak value of MTF represents the relative intensity of the spatial frequency in the nozzle arrangement. Therefore, the smaller the total of products each obtained by a peak value of MTF multiplied by the value of the visual transfer function at the spatial frequency corresponding to the peak value of MTF, the more a human becomes dull to banding having occurred in a print result by the inkjet head. Thus, according to the present invention, in using the inkjet head having 4n nozzle rows, as a line head, banding or white defect caused by the attachment of the inkjet head at an incorrect angle can be hard to be conspicuous. As a result, a good print result can be obtained without requiring the attachment of the inkjet head with high accuracy.

According to another aspect of the present invention, an inkjet head comprises a plurality of nozzles for ejecting ink arranged on an ink ejection face of the inkjet head in a plurality of rows extending parallel to each other in one direction such that projection points of the nozzles obtained by projecting all the nozzles constituting the plurality of rows on an imaginary straight line extending in the one direction, from a direction parallel to a plane including therein the plurality of rows, and perpendicular to each row, are arranged on the imaginary straight line at regular intervals. When $y_i$ (i: a natural number) represents a coordinate value, in a direction perpendicular to the one direction, of the nozzle corresponding to the i-th projection point on the imaginary straight line, one of conditions that the coordinate value $y_{i+1}$, in the direction perpendicular to the one direction, of the nozzle corresponding to the (i+1)th projection point is larger than $y_i$ and the coordinate value $y_{i+2}$, in the direction perpendicular to the one direction, of the nozzle corresponding to the (i+2)th projection point is smaller than $y_{i+1}$, and that the coordinate value $y_{i+1}$, in the direction perpendicular to the one direction, of the nozzle corresponding to the (i+1)th projection point is smaller than $y_i$ and the coordinate value $y_{i+2}$, in the direction perpendicular to the one direction, of the nozzle corresponding to the (i+2)th projection point is larger than $y_{i+1}$, is satisfied for any value of i. In addition, one of conditions that the coordinate value $y_{i+}2$, in the direction perpendicular to the one direction, of the nozzle corresponding to the (i+2)th projection point is larger than $y_i$ and the coordinate value $y_{i+4}$, in the direction perpendicular to the one direction, of the nozzle corresponding to the (i+4)th projection point is smaller than $y_{i+2}$, and that the coordinate value $y_{i+2}$, in the direction perpendicular to the one direction, of the nozzle corresponding to the (i+2)th projection point is smaller than $y_i$ and the coordinate value $y_{i+4}$, in the direction perpendicular to the one direction, of the nozzle corresponding to the (i+4)th projection point is larger than $y_{i+2}$, is satisfied for any value of i.

Also in using the above inkjet head as a line head, it has been found that banding or white defect caused by the attachment of the inkjet head at an incorrect angle is hard to be conspicuous. Therefore, a good print result can be obtained without requiring the attachment of the inkjet head with high accuracy.

In still another aspect of the present invention, an inkjet head comprises a plurality of nozzles for ejecting ink arranged on an ink ejection face of the inkjet head in 4n rows (n: a natural number) extending parallel to each other in one direction such that projection points of the nozzles obtained by projecting all the nozzles constituting the 4n rows on an imaginary straight line extending in the one direction, from a direction parallel to a plane including therein the 4n rows, and perpendicular to each row, are arranged on the imaginary straight line at regular intervals. The plurality of nozzles are arranged in a cycle corresponding to a distance between the projection points at both ends of 4n+1 projection points arranged on the imaginary straight line. When the 4n rows are divided into four groups each constituted by n rows close to each other such that there are not less than n/2 rows belonging to a neighboring row outside the outermost row of each group and there is no row belonging to a non-neighboring row inside the outermost row of each group, the projection points of the nozzles belonging to each group are arranged on the imaginary straight line at regular intervals common to all the groups, and the interval between any pair of neighboring projection points of nozzles belonging to each group includes therein one projection point of a nozzle belonging to each of the other groups. When the 4n rows are divided into two groups each constituted by 2n rows close to each other such that there are not less than 3n/2 rows belonging to the neighboring row outside the outermost row of each group, the projection points of the nozzles belonging to each group are arranged on the imaginary straight line at regular intervals common to both groups, and the interval between any pair of neighboring projection points of nozzles belonging to each group includes therein one projection point of a nozzle belonging to the other group. Further, the plurality of nozzles are arranged symmetrically about a point in a region defined by two imaginary straight lines perpendicular to the one direction and distant from each other by a distance corresponding to one cycle of the arrangement of the plurality of nozzles.

Also in using the above inkjet head as a line head having 4n rows, it has been found that banding or white defect caused by the attachment of the inkjet head at an incorrect angle is hard to be conspicuous. Therefore, a good print result can be obtained without requiring the attachment of the inkjet head with high accuracy. In addition, this inkjet head is advantageous also on the point that it can cope with any of monochrome printing, two-color printing, and four-color printing. Further, a plurality of nozzle groups each constituted by 4n rows can be arranged in a direction parallel to the rows in a state wherein neighboring nozzle groups have been rotated by 180 degrees relatively to each other.

BRIEF DESCRIPTION OF THE DRAWINGS

Other and further objects, features and advantages of the invention will appear more fully from the following description taken in connection with the accompanying drawings in which:

FIG. 20 is a representation showing forty-eight kinds of nozzle arrangement patterns.

DESCRIPTION OF THE PREFERRED EMBODIMENTS

Hereinafter, preferred embodiments of the present invention will be described with reference to drawings.

First Embodiment (Whole Construction of Head)

Figure 1:
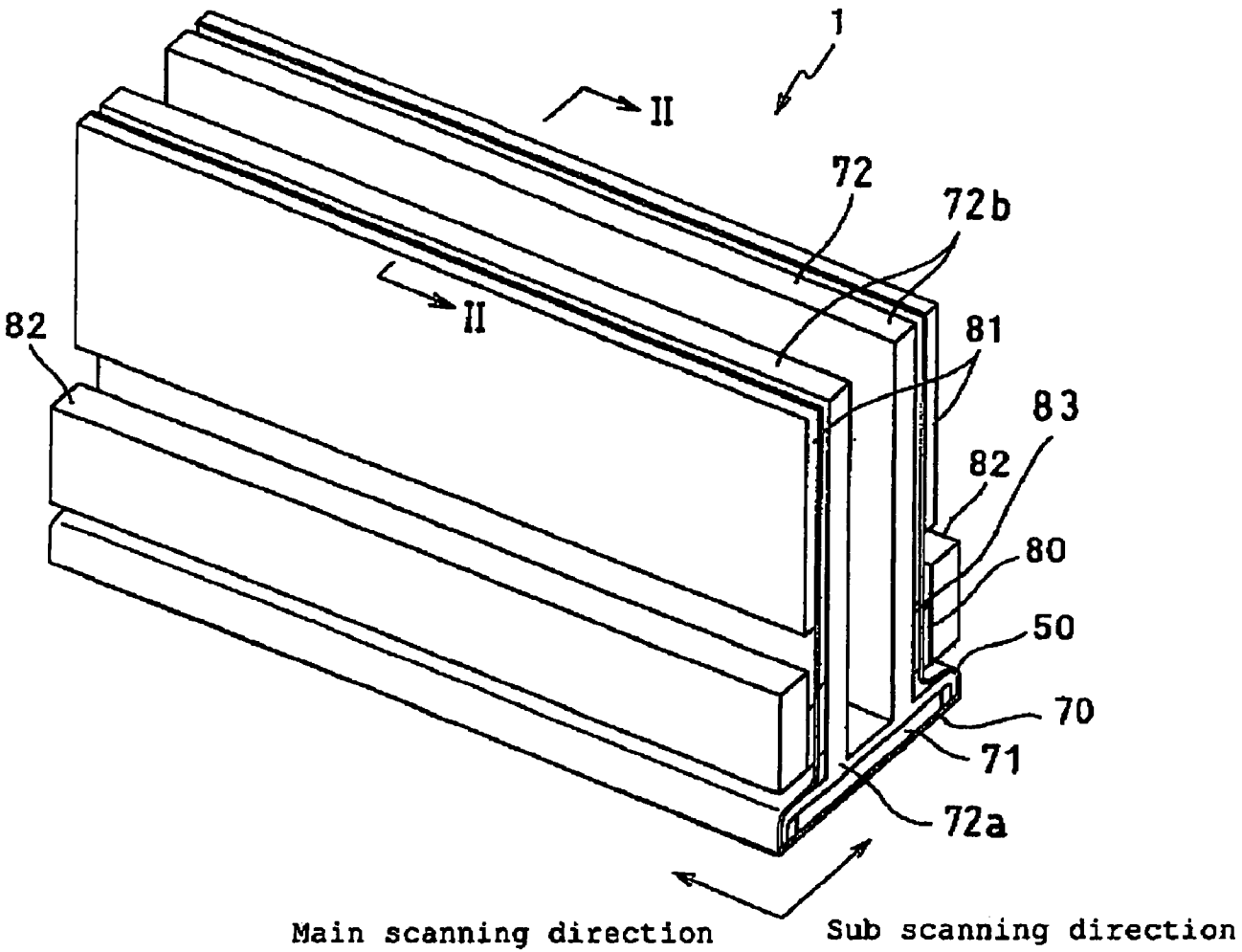
FIG. 1 is an external perspective view of an inkjet head according to a first embodiment of the present invention.
Figure 2:
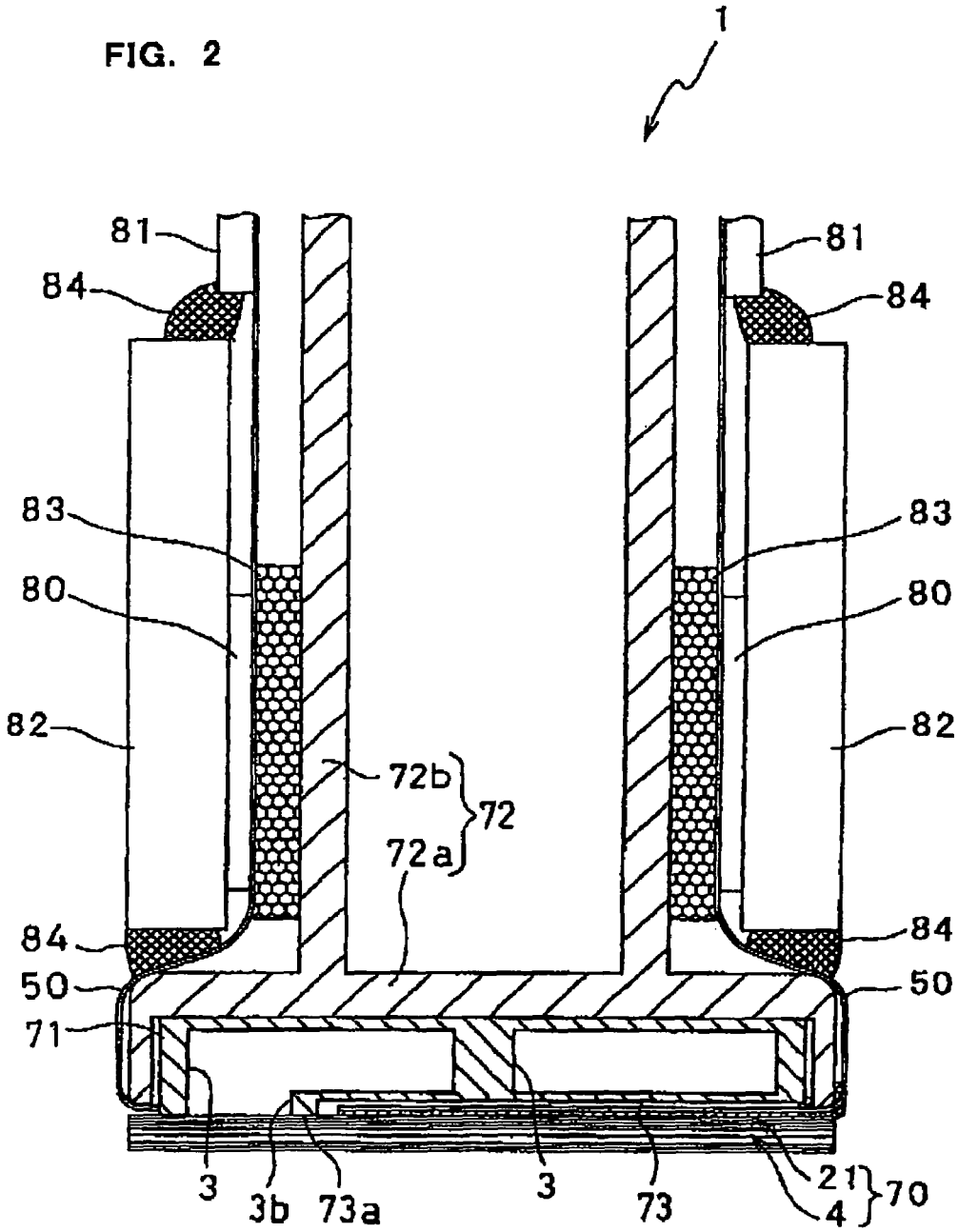
FIG. 2 is a sectional view of the inkjet head of FIG. 1.

An inkjet head according to a first embodiment of the present invention will be described. FIG. 1 shows a perspective view of the inkjet head 1 of this embodiment. FIG. 2 shows h sectional view taken along line II-II in FIG. 1. The inkjet head 1 includes a head main body 70 for ejecting ink onto a paper; and a base block 71 disposed above the head main body 70. The head main body 70 has a rectangular shape in plane extending in a main scanning direction. The base block 71 functions as a reservoir unit in which two ink reservoirs 3 are formed as passages for ink to be supplied to the head main body 70.

The head main body 70 includes a passage unit 4 in which ink passages are formed; and a plurality of actuator units 21 bonded to the upper face of the passage unit 4 with an epoxy-base thermosetting adhesive. Any of the passage unit 4 and actuator units 21 has a layered structure in which a plurality of thin plates are put in layers and bonded to each other. A flexible printed circuit board (hereinafter simply referred to as FPC) 50 as an electric power supply member is bonded by soldering to the upper face of each actuator unit 21. As shown in FIG. 2, each FPC 50 is extended out from the corresponding actuator unit 21 to the left or right.

Figure 3:
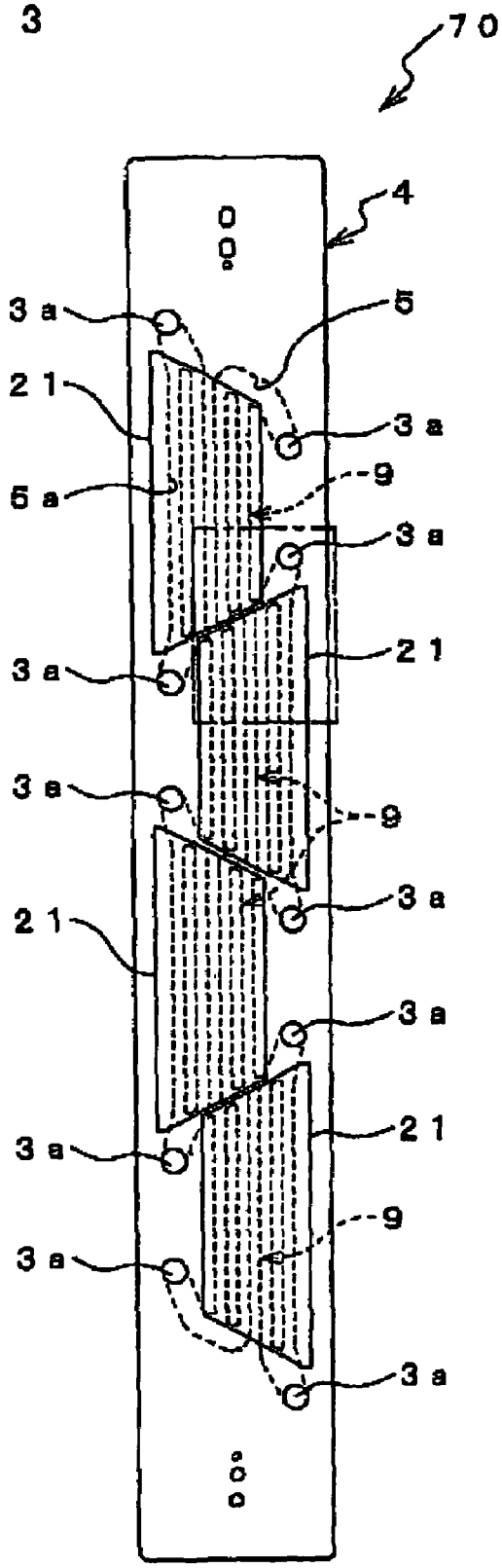
FIG. 3 is a plan view of a head main body of the inkjet head of FIG. 1.

FIG. 3 shows a plan view of the head main body 70. As shown in FIG. 3, the passage unit 4 has a rectangular shape in plane extending in one direction, i.e., the main scanning direction. FIG. 3 shows, by broken lines, manifold flow passages 5 as common ink chambers provided in the passage unit 4. Ink is supplied to each manifold flow passage 5 from an ink reservoir 3 of the base block 71 through a plurality of openings 3*a*. Each manifold flow passage 5 branches into a plurality of sub manifold flow passages 5*a* extending along the length of the passage unit 4.

Four actuator units 21 trapezoidal in plane are bonded to the upper face of the passage unit 4. The actuator units 21 are arranged zigzag in two rows so as to avoid openings 3*a*. Each actuator unit 21 is disposed so that its parallel opposite sides, i.e., its upper and lower sides, extend along the length of the passage unit 4. The opposite oblique sides of neighboring actuator units 21 partially overlap each other in the width of the passage unit 4.

Figure 4:
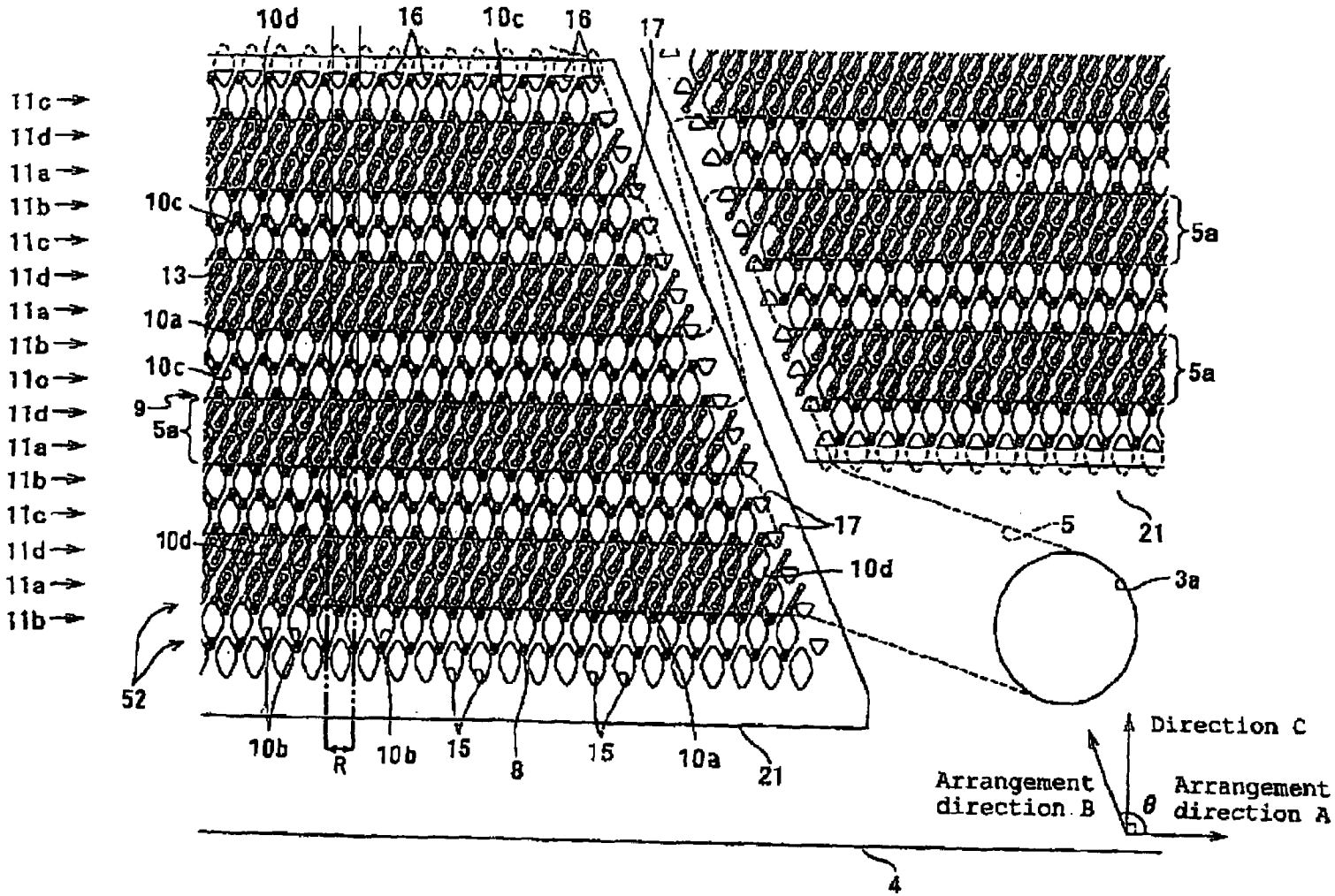
FIG. 4 is an enlarged view of a region enclosed with an alternate long and short dash line in FIG. 3.

An ink ejection region in which a large number of nozzles 8, as shown in FIG. 4, are arranged in a matrix, is formed on the lower face of the passage unit 4 so as to be opposed to the region where each actuator unit 21 is bonded. A pressure chamber group 9 constituted by nearly rhombic pressure chambers 10 arranged in a matrix, as shown in FIG. 4, is formed in a surface portion of the passage unit 4 opposite to each actuator unit 21. In other words, each actuator unit 21 has a size over a large number of pressure chambers 10.

Referring back to FIG. 2, the base block 71 is made of a metallic material such as stainless steel. Each ink reservoir 3 in the base block 71 is defined as a nearly rectangular parallelepiped hollow region formed along the length of the base block 71. Each ink reservoir 3 is connected to a not-shown ink tank through a not-shown opening provided at one end of the ink reservoir 3, and thereby the ink reservoir 3 is always filled with ink. The ink reservoirs 3 have pairs of openings 3*b* arranged zigzag along the lengths of the ink reservoirs 3 such that each opening 3*b* is connected to the corresponding opening 3*a* in a region where no actuator unit 21 is provided.

A portion of the lower face 73 of the base block 71 around each opening 3*b* protrudes downward beyond the other portion of the lower face 73. The base block 71 is in contact with the passage unit 4 only at opening vicinity portions 73*a* of the lower face 73 around the respective openings 3*b*. Thus, the region of the lower face 73 of the base block 71 other than the opening vicinity portions 73*a* is distant from the head main body 70. The actuator units 21 are disposed within the distant region.

The base block 71 is fixedly bonded to a holder 72 within a recess formed on the lower face of a holding portion 72*a* of the holder 72. The holder 72 includes the holding portion 72*a;* and a pair of flat plate-like protrusions 72*b* disposed at a predetermined distance from each other and extending perpendicularly from the upper face of the holding portion 72*a*. The FPC 50 bonded to each actuator unit 21 extends along a surface of a protrusion 72*b* of the holder 72 with an elastic material 83 such as sponge being interposed between the FPC 50 and the surface of the protrusion 72*b*. A driver IC 80 is provided on each FPC 50 in a region opposite to the surface of the corresponding protrusion 72*b* of the holder 72. Each FPC 50 is electrically connected by soldering to both the corresponding driver IC 80 and actuator unit 21 so that the FPC 50 can transmit a drive signal output from the driver IC 80, to the actuator unit 21 of the head main body 70.

A nearly rectangular parallelepiped heat sink 82 is disposed in close contact with the outer surface of each driver IC 80. Thus, heat generated on the driver IC 80 can be effectively radiated. A substrate 81 is disposed outside each FPC 50 in the upper portion of the corresponding driver IC 80 and heat sink 82. Seal members 84 are disposed between the upper face of each heat sink 82 and the corresponding substrate 81 and between the lower face of each heat sink 82 and the corresponding FPC 50. Each seal member 84 is adhered to the corresponding heat sink 82 and substrate 81 or FPC 50.

Figure 5:
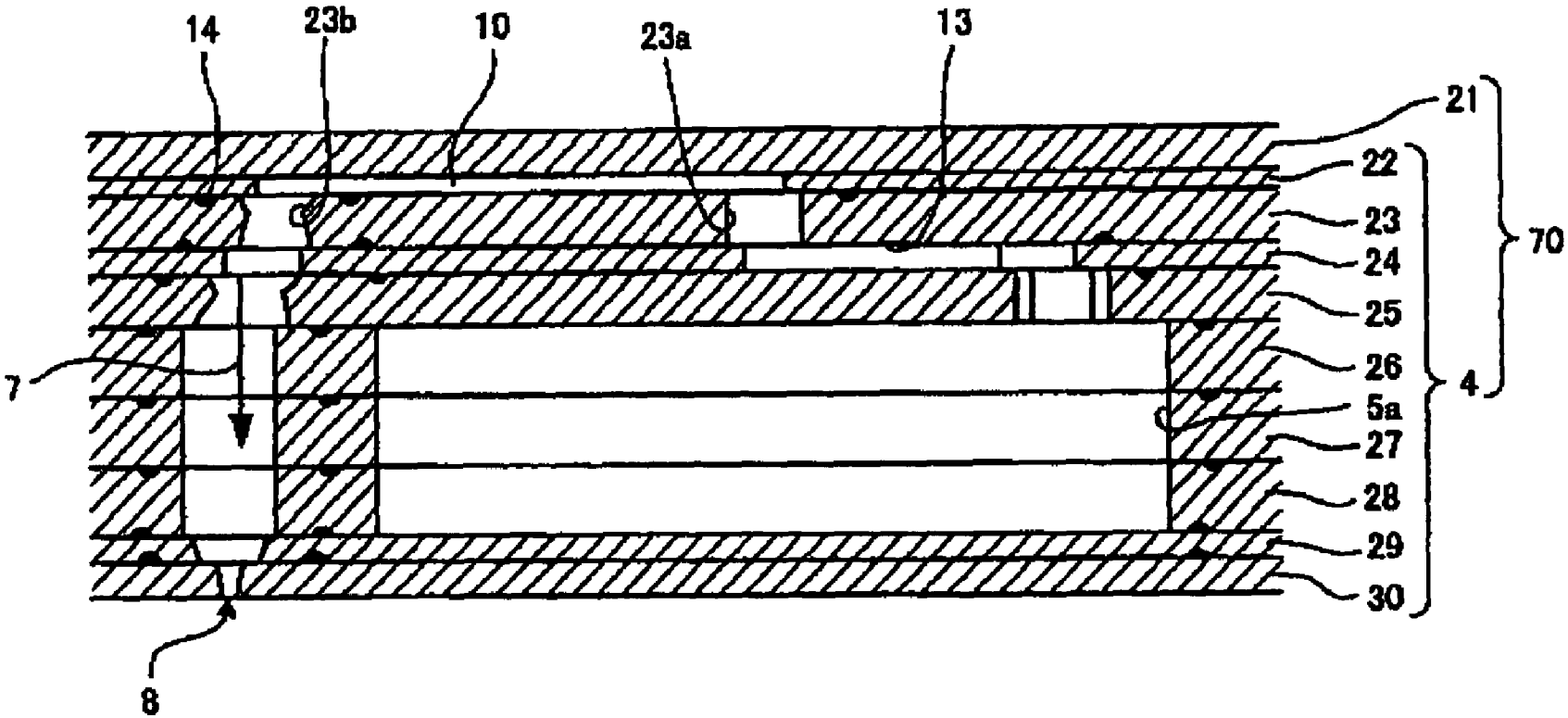
FIG. 5 is a partial sectional view of the head main body of FIG. 3, corresponding to a pressure chamber.

FIG. 4 shows an enlarged view of a region enclosed with an alternate long and short dash line in FIG. 3. As shown in FIG. 4, in a region of the passage unit 4 opposite to each actuator unit 21, four sub manifold flow passages 5*a* extend parallel to the length of the passage unit 4. Each sub manifold flow passage 5*a* is connected to a large number of individual ink flow passages, each of which extends from the corresponding outlet of the sub manifold flow passage 5*a* to a nozzle 8. FIG. 5 is a sectional view showing an individual ink flow passage. As apparent from FIG. 5, each nozzle 8 is connected to a sub manifold flow passage 5*a* through a pressure chamber 10, which is a representative of pressure chambers 10*a*, 10*b*, 10*c*, and 10*d* shown in FIG. 4, and an aperture 13. Thus, an individual ink flow passage 7 is formed for each pressure chamber 10 in the head main body 70 so as to extend from the corresponding outlet of a sub manifold flow passage 5*a* through an aperture 13 and the pressure chamber 10 to the corresponding nozzle 8.

(Sectional Structure of Head)

As apparent from FIG. 5, the head main body 70 has a layered structure in which ten sheet materials in total are put in layers. The sheet materials are constituted by an actuator unit 21, a cavity plate 22, a base plate 23, an aperture plate 24, a supply plate 25, manifold plates 26, 27, and 28, a cover plate 29, and a nozzle plate 30 from the upper side. Of the ten sheet materials, nine plates except the actuator unit 21 constitute the passage unit 4.

Figure 7:
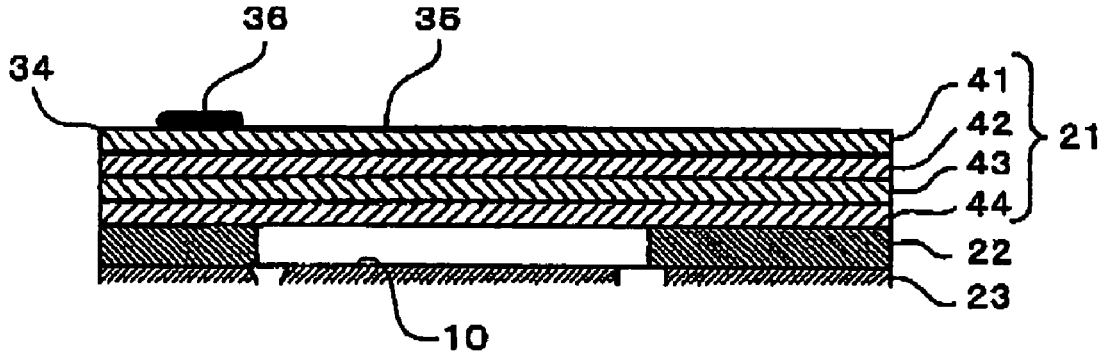
FIG. 7 is a partial sectional view of an actuator shown in FIG. 3.

As will be described later in detail, the actuator unit 21 is made up of four piezoelectric sheets 41 to 44 as shown in FIG. 7. By provision of electrodes, only the uppermost layer functions as a layer having portions to become active when an electric field is applied (hereinafter simply referred to as "layer having active portions"), and the remaining three layers are non-active layers having no active portion. The cavity plate 22 is a metallic plate in which a large number of nearly rhombic holes each forming a space to serve as a pressure chamber 10 are formed in a region where each actuator unit 21 is bonded. The base plate 23 is a metallic plate including therein, for each pressure chamber 10 of the cavity plate 22, a connection hole 23*a* between the pressure chamber 10 and the corresponding aperture 13 and a connection hole 23*b* from the pressure chamber 10 to the corresponding nozzle 8.

The aperture plate 24 is a-metallic plate including therein, for each pressure chamber 10 of the cavity plate 22, a hole to serve as the aperture 13 corresponding to the pressure chamber 10 and a connection hole from the pressure chamber 10 to the corresponding nozzle 8. The supply plate 25 is a metallic plate including therein, for each pressure chamber 10 of the cavity plate 22, a connection hole between the corresponding aperture 13 and sub manifold flow passage 5*a* and a connection hole from the pressure chamber 10 to the corresponding nozzle 8. Each of the manifold plates 26, 27, and 28 is a metallic plate including therein the sub manifold flow passages 5*a* and, for each pressure chamber 10 of the cavity plate 22, a connection hole from the pressure chamber 10 to the corresponding nozzle 8. The cover plate 29 is a metallic plate including therein, for each pressure chamber 10 of the cavity plate 22, a connection hole from the pressure chamber 10 to the corresponding nozzle 8. The nozzle plate 30 is a metallic plate in which nozzles 8 are formed so as to correspond to the respective pressure chambers 10 of the cavity plate 22.

Those ten sheets 21 to 30 are put in layers after adjusted in position to each other such that individual ink flow passages 7 as shown in FIG. 5 are formed therein. Each individual ink flow passage 7 extends first upward from the corresponding sub manifold flow passage 5*a*; horizontally in the aperture 13; further upward from the aperture 13; again horizontally in the pressure chamber 10; downward obliquely to the opposite direction to the aperture 13 in a certain length; and then downward vertically toward the corresponding nozzle 8.

As apparent from FIG. 5, the pressure chamber 10 and the aperture 13 are provided at different levels in the thickness of the plates put in layers. Thus, as shown in FIG. 4, in the region of the passage unit 4 opposite to each actuator unit 21, an aperture 13 connected to one pressure chamber 10 can be disposed so as to overlap, in the plan view, another pressure chamber 10 neighboring the one pressure chamber 10. As a result, pressure chambers 10 can be arranged close to each other at a high density. This can realize image printing at a high resolution with an inkjet head 1 relatively small in its occupation area.

Escape grooves 14 for an excessive adhesive to flow therein are formed on each of the upper and lower faces of the base plate 23 and the manifold plate 28, the upper faces of the supply plate 25 and the manifold plates 26 and 27, and the lower face of the cover plate 29 so as to enclose the respective openings formed on the face of each plate to be bonded. Such an escape groove 14 prevents an adhesive for bonding plates from being forced in an individual ink flow passage 7 to vary the flow passage resistance.

(Detail of Passage Unit)

Referring back to FIG. 4, a pressure chamber group 9 constituted by a large number of pressure chambers 10 is formed in a region where an actuator unit 21 is bonded. The pressure chamber group 9 has a trapezoidal shape having substantially the same size as the region where the actuator unit 21 is bonded. One pressure chamber group 9 is formed to correspond to each actuator unit 21.

Figure 6:
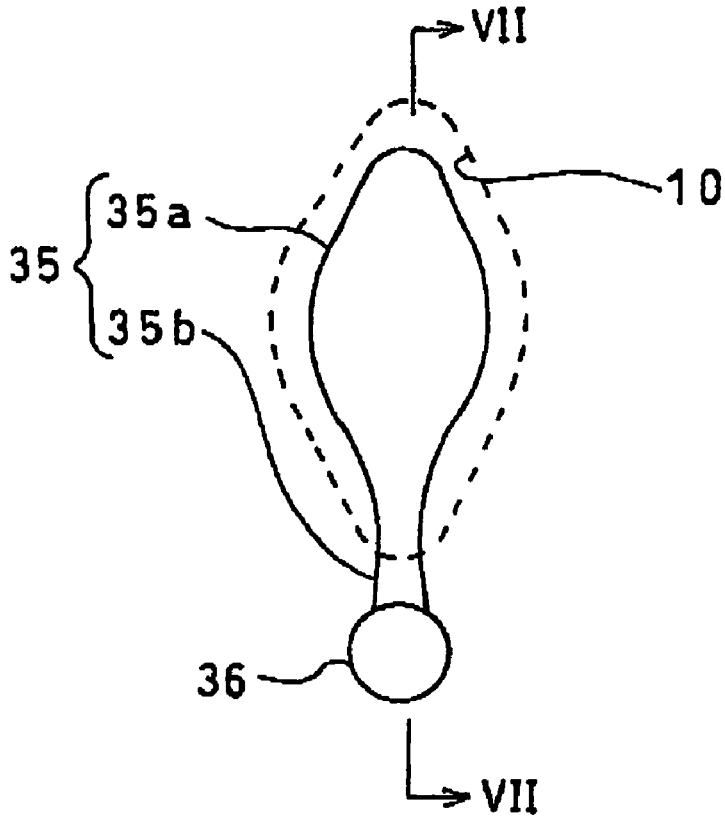
FIG. 6 is a plan view of an individual electrode formed on an actuator shown in FIG. 3.

As apparent from FIG. 4, each pressure chamber 10 belonging to the pressure chamber group 9 is connected at one end of its longer diagonal to the corresponding nozzle 8, and at the other end of its longer diagonal to the corresponding sub manifold flow passage 5*a* through the corresponding aperture 13. As will be described later, individual electrodes 35 each nearly rhombic in plane and being a size smaller than a pressure chamber 10, as shown in FIGS. 6 and 7, are arranged in a matrix on each actuator unit 21 so as to be opposed to the respective pressure chambers 10. In FIG. 4, in order to make the figure easy to be understood, nozzles 8, pressure chambers 10, apertures 13, etc., are shown by solid lines though they should be shown by broken lines because they are in the passage unit 4.

Pressure chambers 10 are arranged close to each other in a matrix in two directions, that is, an arrangement direction A, i.e., a first direction, and an arrangement direction B, i.e., a second direction. The arrangement direction A is along the length of the inkjet head 1, that is, the length of the passage unit 4, and parallel to the shorter diagonal of each pressure chamber 10. The arrangement direction B is parallel to one oblique side of each pressure chamber 10 at an obtuse angle theta with the arrangement direction A. Either of the acute portions of each pressure chamber 10 is in between two pressure chambers 10 neighboring to that pressure chamber 10. The arrangement direction A is parallel to the main scanning direction.

The pressure chambers 10 arranged close to each other in a matrix in two of the arrangement directions A and B are at intervals in the arrangement direction A corresponding to 37.5 dpi. In each region corresponding to one actuator unit 21, sixteen pressure chambers 10 are arranged in the arrangement direction B.

A large number of pressure chambers 10 arranged in a matrix, form a plurality of pressure chamber rows extending in the arrangement direction A in FIG. 4. The pressure chamber rows are categorized into first pressure chamber rows 11*a*, second pressure chamber rows 11*b*, third pressure chamber rows 11*c*, and fourth pressure chamber rows 11*d* in accordance with relative positions to the sub manifold flow passages 5*a* when viewed from a third direction perpendicular to FIG. 4. The first to fourth pressure chamber rows 11*a* to 11*d* are arranged periodically in unit of four in the order of 11*c*, 11*d*, 11*a*, 11*b*, 11*c*, 11*d*, . . . , and 11*b*.

In any of the pressure chambers 10*a* constituting each first pressure chamber row 11*a* and the pressure chambers 10*b* constituting each second pressure chamber row 11*b*, when viewed from the third direction, the corresponding nozzle 8 is on the lower side of the pressure chambers 10*a* or 10*b* in FIG. 4 with respect to a direction C perpendicular to the arrangement direction A in FIG. 4. The direction C is parallel to the sub scanning direction. More specifically, as for each pressure chamber 10*a*, when viewed from the third direction, the corresponding nozzle 8 is substantially opposed to the lower acute portion of the pressure chamber 10*a*. As for each pressure chamber 10*b*, when viewed from the third direction, the corresponding nozzle 8 is opposed to a middle portion of the length of the pressure chamber 10*c* neighboring the pressure chamber 10*b* on the lower right side of the lower acute portion of the pressure chamber 10*b*. On the other hand, in any of the pressure chambers 10*c* constituting each third pressure chamber row 11*c* and the pressure chambers 10*d* constituting each fourth pressure chamber row 11*d*, when viewed from the third direction, the corresponding nozzle 8 is on the upper side of the pressure chambers 10*c* or 10*d* in FIG. 4 with respect to the direction C. More specifically, as for each pressure chamber 10*c*, when viewed from the third direction, the corresponding nozzle 8 is opposed to a position somewhat distant to the upper right from the upper acute portion of the pressure chamber 10*c*. As for each pressure chamber 10*d*, when viewed from the third direction, the corresponding nozzle 8 is opposed to the vicinity of the lower end of the length of the pressure chamber 10*c* neighboring the pressure chamber 10*d* on the upper right side of the upper acute portion of the pressure chamber 10*d*.

In any of the first and fourth pressure chamber rows 11*a* and 11*d*, when viewed from the third direction, a region more than a half of each pressure chamber 10*a* or 10*d* overlaps a sub manifold flow passage 5*a*. In any of the second and third pressure chamber rows 11*b* and 11*c*, when viewed from the third direction, substantially the whole region of each pressure chamber 10*b* or 10*c* overlaps no sub manifold flow passage 5*a*. Thus, the width of each sub manifold flow passage 5*a* can be increased as wide as possible with designing such that the nozzle 8 connected to any pressure chamber 10 belonging to any pressure chamber row does not overlap any sub manifold flow passage 5*a*, and ink can be smoothly supplied to each pressure chamber 10.

(Detail of Actuator Unit)

Next, the construction of an actuator unit 21 will be described. On each actuator unit 21, a large number of individual electrodes 35 are arranged in a matrix in the same pattern as the pressure chambers 10. In each individual electrode 35 is disposed so as to overlap the corresponding pressure chamber 10 in the plan view.

FIG. 6 shows a plan view of an individual electrode 35. As shown in FIG. 6, the individual electrode 35 has a main electrode portion 35*a* and an auxiliary electrode portion 35*b* extending from the main electrode portion 35*a*. The main electrode portion 35*a* is disposed so as to overlap the corresponding pressure chamber 10 and be included within the pressure chamber 10 in the plan view. The auxiliary electrode portion 35*b* is substantially outside the pressure chamber 10 in the plan view.

FIG. 7 shows a sectional view taken along line VII-VII in FIG. 6. As shown in FIG. 7, the actuator unit 21 includes four piezoelectric sheets 41, 42, 43, and 44 formed into the same thickness as about 15 micrometers. The piezoelectric sheets 41 to 44 are formed into a continuous flat layer to be disposed over a large number of pressure chambers 10 formed in one ink ejection region in the head main body 70. Because the piezoelectric sheets 41 to 44 are formed into a continuous flat layer to be disposed over a large number of pressure chambers 10, individual electrodes 35 can be arranged at a high density on the piezoelectric sheet 41, for example, by using a screen printing technique. As a result, the pressure chambers 10 formed so as to correspond to the respective individual electrodes 35 can also be arranged at a high density. This realizes image printing at a high resolution. Each of the piezoelectric sheets 41 to 44 is made of a lead zirconate titanate (PZT)-base ceramic material having ferroelectricity.

As shown in FIG. 6, the main electrode portion 35*a* of the individual electrode 35 formed on the uppermost piezoelectric sheet 41 has a nearly rhombic shape in plane substantially similar to that of a pressure chamber 10. The lower acute portion of the nearly rhombic main electrode portion 35*a* is extended to be connected to the auxiliary electrode portion 35*b* disposed outside the corresponding pressure chamber 10. A circular land 36 electrically connected to the individual electrode 35 is provided at an end of the auxiliary electrode portion 35*b*. As shown in FIG. 7, the land 36 is opposed to a region of the cavity plate 22 where no pressure chamber 10 is formed. The land 36 is made of, for example, gold containing glass frit. As shown in FIG. 6, the land 36 is adhered to the upper surface of an extension of the auxiliary electrode portion 35*b*. Although the corresponding FPC 50 is omitted in FIG. 7, the land 36 is electrically connected to a contact provided on the FPC 50. To make such a connection, the contact of the FPC 50 must be pressed onto the land 36. In this embodiment, because the region of the cavity plate 22 opposite to the land 36 includes therein no pressure chamber 10, a sure connection can be made by sufficiently pressing.

An about 2 micrometers-thick common electrode 34 having the same contour as the piezoelectric sheet 41 is interposed between the uppermost piezoelectric sheet 41 and the second uppermost piezoelectric sheet 42 in substantially the whole area of the piezoelectric sheet 41. Each of the individual electrodes 35 and the common electrode 34 is made of, for example, an Ag—Pd-base metallic material.

The common electrode 34 is grounded in a not-shown region to be kept at a ground potential. Thus, in a region corresponding to any pressure chamber 10, the common electrode 34 is equally kept at a certain potential, i.e., the ground potential in this embodiment. Each individual electrode 35 is connected to the corresponding driver IC 80 through the corresponding FPC 50 including a plurality of leads independent of one another to correspond to the respective individual electrodes 35, so that the individual electrodes 35 corresponding to the respective pressure chambers 10 can be controlled in their potentials independently of one another.

(Driving Method of Actuator Unit)

Next, a driving method of the actuator unit 21 will be described. The piezoelectric sheet 41 of the actuator unit 21 is polarized along the thickness of the piezoelectric sheet 41. The actuator unit 21 has a so-called unimorph type structure in which the upper one piezoelectric sheet 41, far from each pressure chamber 10, functions as a layer having therein active portions while the lower three piezoelectric sheets 42 to 44, near to each pressure chamber 10, function as non-active layers. Therefore, when an individual electrode 35 is put at a positive or negative predetermined potential, if the electric field is generated, for example, in the same direction as polarization, the portion of the piezoelectric sheet 41 that is sandwiched by electrodes and the electric field has been applied to, functions as an active portion, i.e., a pressure generation portion. Thus, the portion of the piezoelectric sheet 41 contracts perpendicularly to the polarization by the transverse piezoelectric effect.

In this embodiment, the portion of the piezoelectric sheet 41 sandwiched by the common electrode 34 and the main electrode portion 35*a* of each individual electrode 35 functions as an active portion that generates distortion by the piezoelectric effect when an electric field is applied. On the other hand, no electric field is externally applied to three piezoelectric sheets 42 to 44 under the piezoelectric sheet 41, and thus the piezoelectric sheets 42 to 44 scarcely function as active portions. Therefore, the portion of the piezoelectric sheet 41 sandwiched by the common electrode 34 and the main electrode portion 35*a* of the individual electrode 35 mainly contracts perpendicularly to the polarization by the transverse piezoelectric effect.

The piezoelectric sheets 42 to 44 are not deformed by themselves because they suffer no electric field. Thus, there is generated difference in distortion perpendicular to polarization between the upper piezoelectric sheet 41 and the lower piezoelectric sheets 42 to 44. As a result, the whole of the piezoelectric sheets 41 to 44 is going to be deformed convexly toward the non-active side, which is called unimorph deformation. At this time, as shown in FIG. 7, the lower face of the actuator unit 21 constituted by the piezoelectric sheets 41 to 44 is fixed to the upper face of the cavity plate 22 as partition walls defining each pressure chamber 10. As a result, the piezoelectric sheets 41 to 44 are deformed convexly into the corresponding pressure chamber 10. Thus, the volume of the pressure chamber 10 is decreased; the pressure of ink is raised; and then ink is ejected through the corresponding nozzle 8. Afterward, when the individual electrode 35 is returned to the same potential as the common electrode 34, the piezoelectric sheets 41 to 44 are restored to their original shape. Thus, the pressure chamber 10 is restored to its original volume and then ink is sucked from the corresponding sub manifold flow passage 5*a* into the pressure chamber 10.

In another driving method, any individual electrode 35 is put in advance at a potential different from that of the common electrode 34. Every time when an ejection request is received, the corresponding individual electrode 35 is once put at the same potential as the common electrode 34. Afterward, at a predetermined timing, the individual electrode 35 is again put at the potential different from that of the common electrode 34. In this case, at the timing when the individual electrode 35 is put at the same potential as the common electrode 34, the piezoelectric sheets 41 to 44 are restored to their original shape. The volume of the corresponding pressure chamber 10 then increases from its initial state, i.e., a state when both electrodes differ from each other in potential. Ink is then sucked from the corresponding sub manifold flow passage 5*a* into the pressure chamber 10. Afterward, at the timing when the individual electrode 35 is again put at the potential different from that of the common electrode 34, the piezoelectric sheets 41 to 44 are deformed convexly into the pressure chamber 10. The pressure of ink is then raised because of a decrease in volume of the pressure chamber 10, and thereby ink is ejected. In an inkjet head 1 as described above, when each actuator unit 21 is properly driven in accordance with conveyance of a print medium, a character, a figure, or the like, can be printed at a resolution of 600 dpi.

(Detail of Nozzle Arrangement)

Figure 8:
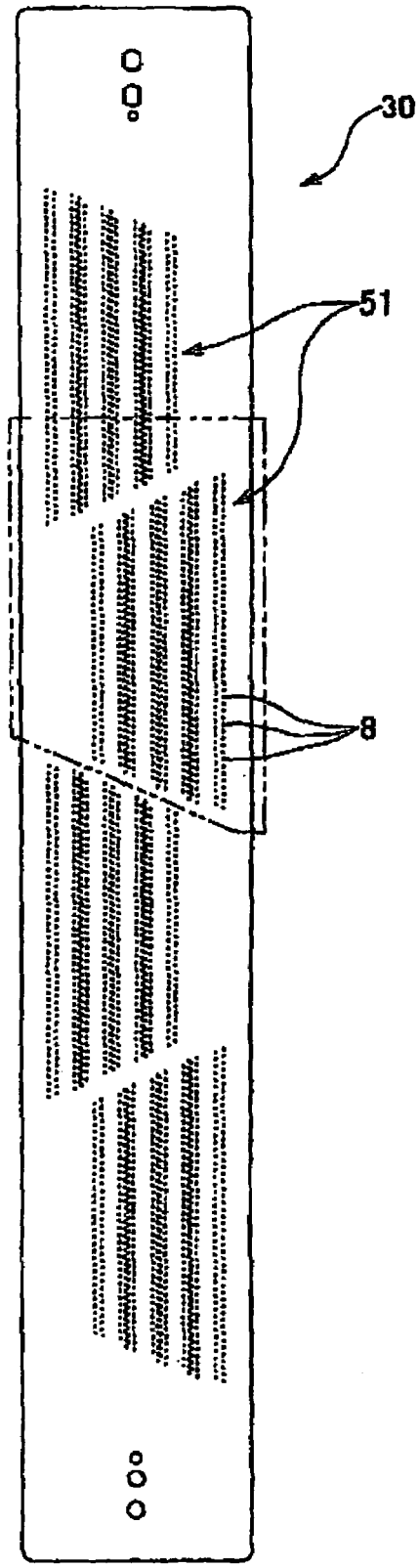
FIG. 8 is a plan view of a nozzle plate shown in FIG. 5.

FIG. 8 shows a plan view of the nozzle plate 30 shown in FIG. 5. On the nozzle plate 30, as shown in FIG. 8, four nozzle groups 51 in each of which a plurality of nozzles 8 are arranged close to each other in a matrix, are formed so as to correspond to the respective ink ejection regions. The four nozzle groups 51 are arranged zigzag in two rows. Each nozzle group 51 has a trapezoidal region substantially the same shape in plane as each actuator unit 21. The parallel opposite sides of each nozzle group 51 are disposed along the length of the nozzle plate 30. The opposite oblique sides of neighboring nozzle groups 51 partially overlap each other in the width of the nozzle plate 30.

Figure 9:
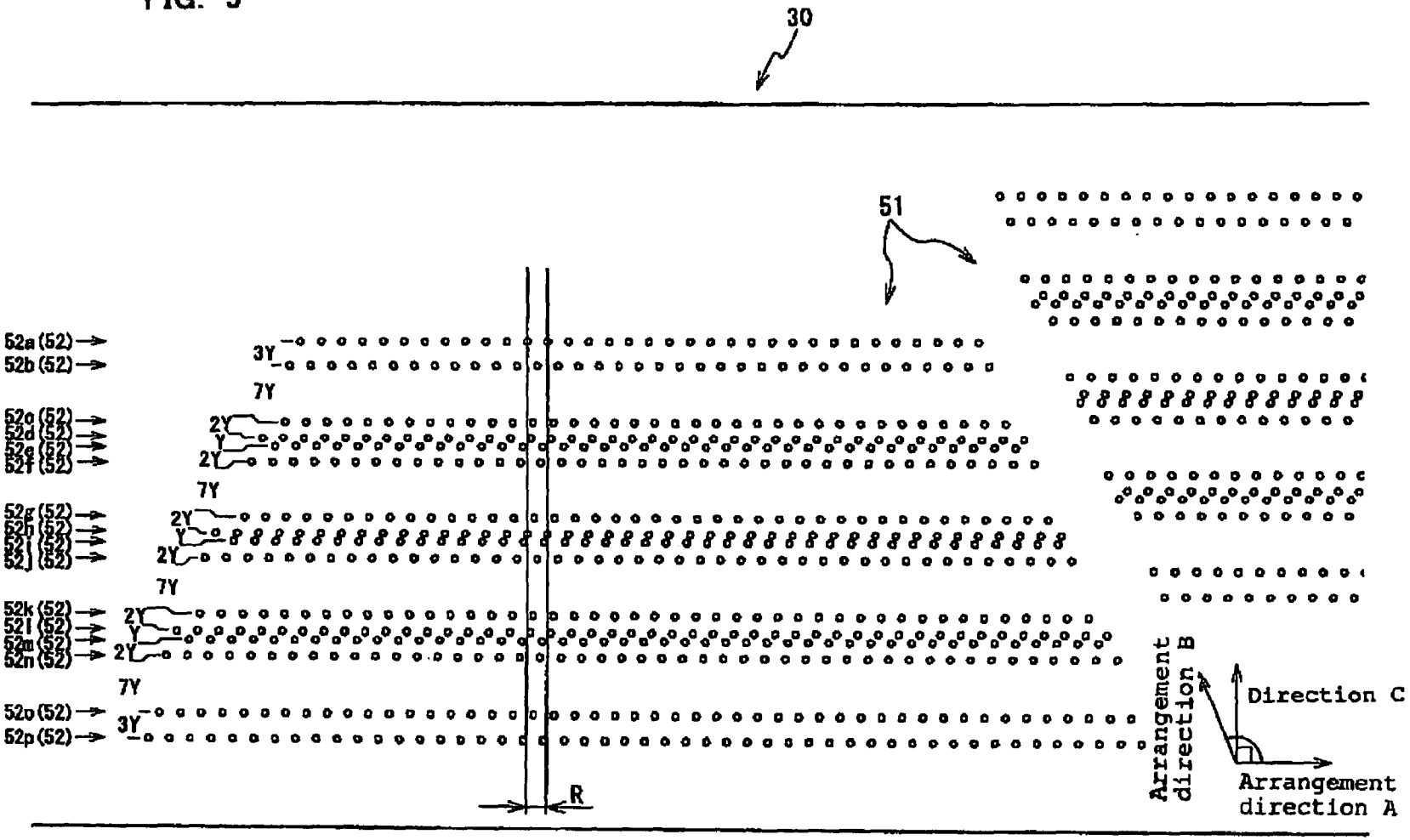
FIG. 9 is an enlarged plan view of a region enclosed with an alternate long and two dashes line in FIG. 8.

FIG. 9 shows an enlarged plan view of a region enclosed with an alternate long and two short dashes line in FIG. 8. As shown in FIG. 9, each nozzle group 51 has sixteen nozzle rows 52 in each of which nozzles 8 are arranged in the arrangement direction A. The sixteen nozzle rows 52 are parallel to each other. The nozzles 8 constituting each nozzle row 52 are at intervals corresponding to 37.5 dpi. The arrangement direction A is along the length of the inkjet head 1, i.e., the length of the passage unit 4. The arrangement direction A is parallel to the above-described main scanning direction.

Each nozzle row 52 is disposed so as not to be opposed to any sub manifold flow passage 5*a* as shown in FIG. 4. Of the nozzle rows 52 in each nozzle group 51, the nozzle row 52 nearest to the shorter side of the nozzle group 51 is referred to as a first nozzle row 52*a*, and the remaining nozzle groups 52 are referred to as a second nozzle row 52*b*, a third nozzle group 52*c*, . . . , and a sixteenth nozzle row 52*p* in turn toward the longer side of the nozzle group 51. In this case, the number of nozzles 8 constituting the first nozzle row 52*a* is the smallest while the number of nozzles 8 constituting the sixteenth nozzle row 52*p* is the largest. That is, in the direction from the longer side toward the shorter side of the nozzle group 51, the number of nozzles 8 constituting each nozzle row 52 reduces.

As shown in FIG. 9, the sixteen nozzle rows 52 are disposed such that the intervals between the fourth and fifth nozzle rows 52*d* and 52*e*, between the eighth and ninth nozzle rows 52*h* and 52*i*, and between the twelfth and thirteenth nozzle rows 52*l* and 52*m*, are the narrowest. When the narrowest interval is represented by Y, each of the widest intervals between the second and third nozzle rows 52*b* and 52*c*, between the sixth and seventh nozzle rows 52*f* and 52*g*, between the tenth and eleventh nozzle rows 52*j* and 52*k*, and between the fourteenth and fifteenth nozzle rows 52*n* and 52*o*, corresponds to 7Y.

FIG. 9 shows a belt-like region R having a width of 678.0 micrometers corresponding to 37.5 dpi in the arrangement direction A and extending in the direction C perpendicular to the arrangement direction A. The left border line of the belt-like region R extends on a nozzle belonging to the nozzle row 52*a*. The belt-like region R includes therein one nozzle belonging to each of the nozzle rows 52*a* to 52*p*.

Figure 10:
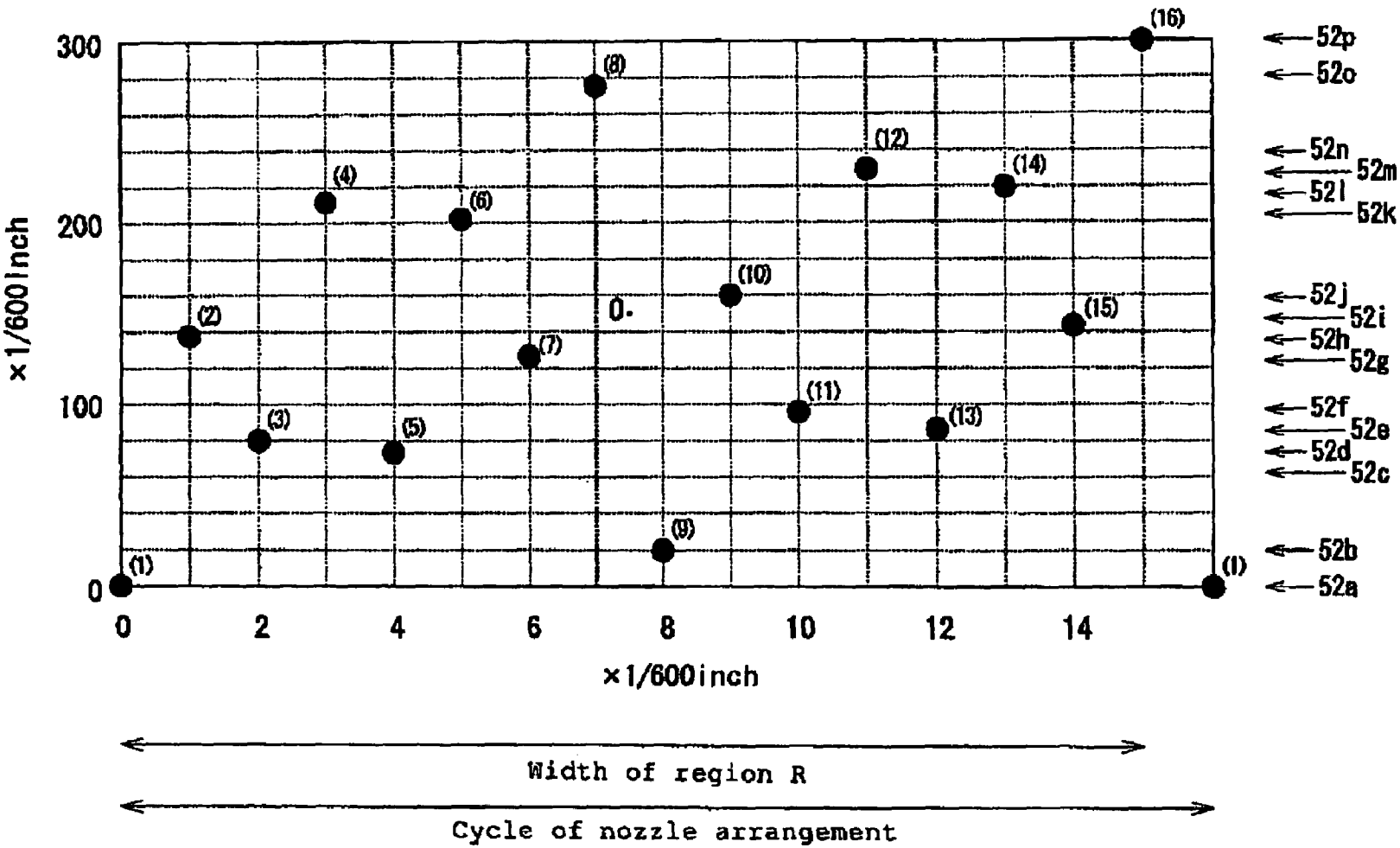
FIG. 10 is a representation showing, in an enlarged form, the positional relation of sixteen nozzles belonging to a belt-like region R shown in FIG. 9.
Figure 11:
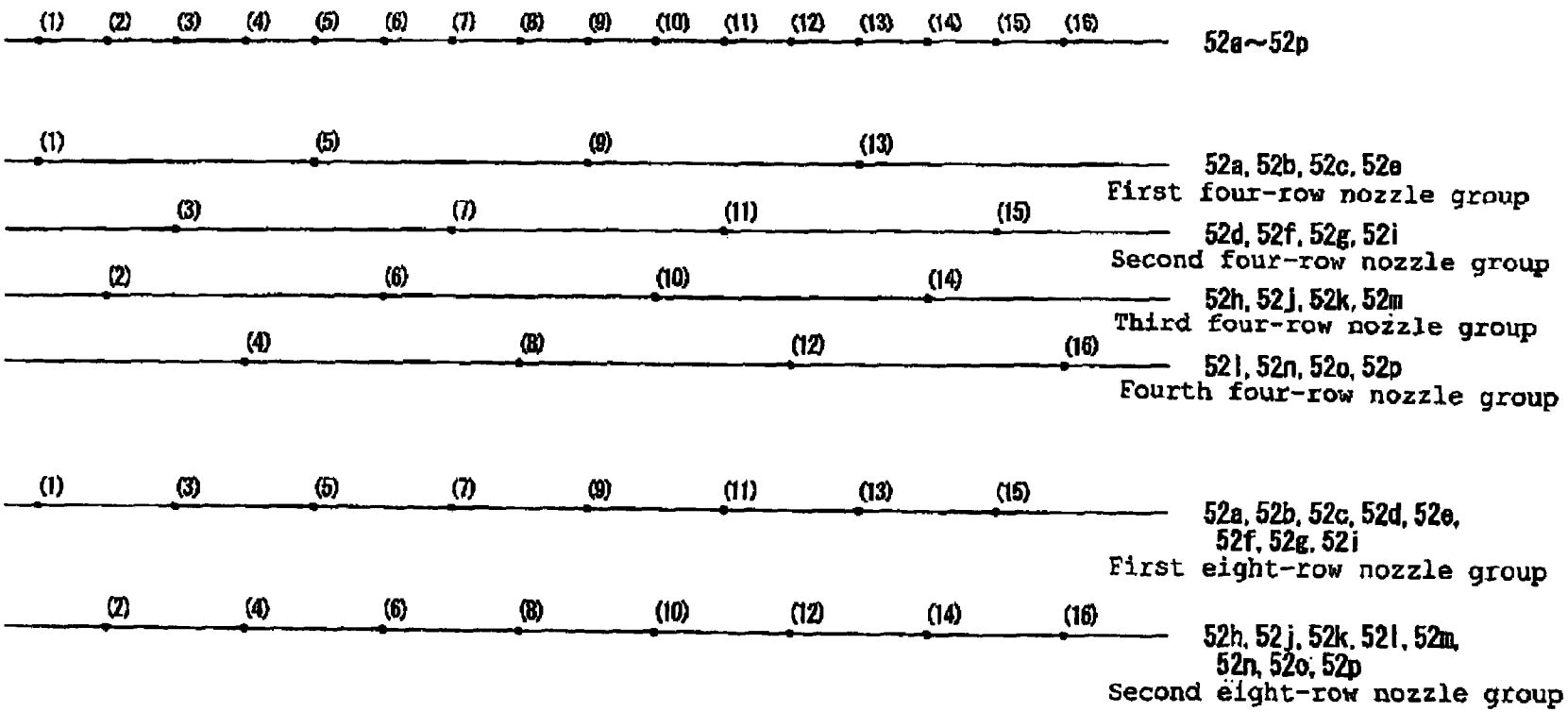
FIG. 11 is a representation showing an arrangement rule of the sixteen nozzles of FIG. 10.

FIG. 10 shows, in an enlarged form, the positional relation of sixteen nozzles 8 belonging to one belt-like region R. FIG. 11 is for explaining an arrangement rule of the sixteen nozzles of FIG. 10. In FIG. 10, the vertical and horizontal scales differ from each other, and the vertical positions of the nozzles 8 are inverted from FIG. 9 for conveniences' sake. As shown in FIG. 10, when the sixteen nozzles 8 are projected on an imaginary straight line extending in the arrangement direction A, from a direction perpendicular to the arrangement direction A, the obtained projection points are arranged at intervals corresponding to a print resolution of 600 dpi, as shown in FIG. 11. Thus, when each actuator unit 21 is properly driven in accordance with conveyance of a print medium, a character, a figure, or the like, can be printed at a resolution of 600 dpi.

On the nozzle plate 30, a large number of nozzles 8 are arranged in a cycle obtained by adding the width of the belt-like region R corresponding to 37.5 dpi, to the width of the interval between neighboring projection points, corresponding to 600 dpi. That is, even if such a belt-like region R having its left border line extending on a nozzle 8 belonging to the nozzle row 52*a* is set at any position in the nozzle group 51, the same pattern of nozzle arrangement is obtained in the belt-like region R.

When the sixteen nozzles 8 of FIG. 10 are numbered by (1) to (16) in order from the left, the sixteen nozzles 8 are arranged in the order of (1), (9), (5), (3), (13), (11), (7), (2), (15), (10, (6), (4), (14), (12), (8), and (16) from the lower side, i.e., from the upper side in FIG. 9.

As is understood from FIG. 10, the sixteen nozzles 8 are arranged zigzag in the arrangement direction A. More specifically, when the coordinate value of each nozzle 8 in the direction C is represented by yi where i is a number for specifying each nozzle 8 and one of (1) to (16) in the present case, there is satisfied a condition of y(1)<y(2)>y(3)<y(4)>y(5)<y(6)>y(7)<y(8)>y(9)<y(10)>y(11)<y(12)>y(13)<y(14)>y(15)<y(16).

In addition, when only nozzles 8 in odd or even numbers are taken out of the sixteen nozzles 8, they also form a zigzag arrangement in the arrangement direction A. More specifically, there are satisfied both the conditions of y(1)<y(3)>y(5)<y(7)>y(9)<y(11)>y(13)<y(15); and of y(2)<y(4)>y(6)<y(8)>y(10)<(12)>y(14)<y(16).

As is understood by comparing FIG. 9 with FIG. 4, any nozzle 8 belonging to four nozzle rows 52*a*, 52*b*, 52*c*, and 52*e* is connected to a common sub manifold flow passage 5*a*, Any nozzle 8 belonging to four nozzle rows 52*d*, 52*g*, 52*f*, and 52*i* is connected to a common sub manifold flow passage 5*a* neighboring on the lower side of the sub manifold flow passage 5*a* to which the nozzles 8 belonging to the four nozzle rows 52*a*, 52*b*, 52*c*, and 52*e* are connected. Any nozzle 8 belonging to four nozzle rows 52*h*, 52*k*, 52*j*, and 52*m* is connected to a common sub manifold flow passage 5*a* neighboring on the lower side of the sub manifold flow passage 5*a* to which the nozzles 8 belonging to the four nozzle rows 52*d*, 52*g*, 52*f*, and 52*i* are connected. Any nozzle 8 belonging to four nozzle rows 52*l*, 52*o*, 52*n*, and 52*p* is connected to a common sub manifold flow passage 5*a* neighboring on the lower side of the sub manifold flow passage 5*a* to which the nozzles 8 belonging to the four nozzle rows 52*h*, 52*k*, 52*j*, and 52*m* are connected.

Therefore, in the case that the manifold design is changed from that shown in FIG. 4 such that inks of different colors flow in the respective sub manifold flow passages 5*a*, the sixteen nozzle rows 52*a* to 52*p* can be divided into four groups each constituted by four nozzle rows 52 that eject ink of the same color, each of which groups will be referred to as a four-row nozzle group. More specifically, the sixteen nozzle rows 52*a* to 52*p* can be divided into a group constituted by four nozzle rows 52*a*, 52*b*, 52*c*, and 52*e*, which group will be referred to as a first four-row group; a group constituted by four nozzle rows 52*d*, 52*f*, 52*g*, and 52*i*, which group will be referred to as a second four-row group; a group constituted by four nozzle rows 52*h*, 52*j*, 52*k*, and 52*m*, which group will be referred to as a third four-row group; and a group constituted by four nozzle rows 52*l*, 52*n*, 52*o*, and 52*p*, which group will be referred to as a fourth four-row group.

In this case, as shown in FIG. 11, when four nozzles (1), (5), (9), and (13) belonging to the first four-row nozzle group of the sixteen nozzles 8 belonging to the belt-like region R are projected on an imaginary straight line extending in the arrangement direction A, from a direction perpendicular to the arrangement direction A, the projection points of the four nozzles are arranged at intervals corresponding to 150 dpi. Likewise, when four nozzles (3), (7), (11), and (15) belonging to the second four-row nozzle group, four nozzles (2), (6), (10), and (14) belonging to the third four-row nozzle group, and four nozzles (4), (8), (12), and (16) belonging to the fourth four-row nozzle group, are projected on the imaginary straight line extending in the arrangement direction A, from the direction perpendicular to the arrangement direction A, any group of the projection points are also arranged at intervals corresponding to 150 dpi.

In addition, between each pair of neighboring projection points of nozzles 8 belonging to any four-row nozzle group, there is one projection point of a nozzle 8 belonging to each of the other four-row groups. More specifically, between neighboring projection points of the nozzles (5) and (9) belonging to the first four-row group, there are the projection point of the nozzle (7) belonging to the second four-row group, the projection point of the nozzle (6) belonging to the third four-row group, and the projection point of the nozzle (8) belonging to the fourth four-row group. As another example, between neighboring projection points of the nozzles (10) and (14) belonging to the third four-row group, there are the projection point of the nozzle (13) belonging to the first four-row group, the projection point of the nozzle (11) belonging to the second four-row group, and the projection point of the nozzle (12) belonging to the fourth four-row group.

Because four four-row nozzle groups of the first to fourth four-row nozzle groups have such a character, the inkjet head 1 of this embodiment can cope with not only monochrome printing but also four-color printing.

Further, in the case that the manifold design is changed from that shown in FIG. 4 such that inks of different colors flow in the respective pairs of neighboring sub manifold flow passages 5*a*, the sixteen nozzle rows 52*a* to 52*p* can be divided into two eight-row nozzle groups each constituted by eight nozzle rows 52 that eject ink of the same color. More specifically, the sixteen nozzle rows 52*a* to 52*p* can be divided into a group constituted by eight nozzle rows 52*a*, 52*d*, 52*c*, 52*g*, 52*b*, 52*f*, 52*e*, and 52*i*, which group will be referred to as a first eight-row nozzle group; and a group constituted by eight nozzle rows 52*h*, 52*l*, 52*k*, 52*o*, 52*j*, 52*n*, 52*m*, and 52*p*, which group will be referred to as a second eight-row nozzle group.

In this case, as shown in FIG. 11, when eight nozzles (1), (3), (5), (7), (9), (11), (13), and (15) belonging to the first eight-row nozzle group of the sixteen nozzles 8 belonging to the belt-like region R are projected on an imaginary straight line extending in the arrangement direction A, from a direction perpendicular to the arrangement direction A, the projection points of the eight nozzles are arranged at intervals corresponding to 300 dpi. Likewise, when eight nozzles (2), (4), (6), (8), (10), (12), (14), and (16) belonging to the second eight-row nozzle group are projected on the imaginary straight line extending in the arrangement direction A, from the direction perpendicular to the arrangement direction A, the projection points of the eight nozzles are also arranged at intervals corresponding to 300 dpi.

In addition, between each pair of neighboring projection points of nozzles 8 belonging to any eight-row nozzle group, there is one projection point of a nozzle 8 belonging to the other eight-row nozzle group. More specifically, between neighboring projection points of the nozzles (5) and (7) belonging to the first eight-row nozzle group, there is the projection point of the nozzle (6) belonging to the second eight-row nozzle group. As another example, between neighboring projection points of the nozzles (10) and (12) belonging to the second eight-row nozzle group, there is the projection point of the nozzle (11) belonging to the first eight-row nozzle group.

Because two groups of the first and second eight-row nozzle groups have such a character, the inkjet head 1 of this embodiment can cope with two-color printing in addition to monochrome printing and four-color printing.

As is understood from FIG. 10, sixteen nozzles 8 are arranged symmetrically about a point within the belt-like region R or a region corresponding to one cycle of nozzle arrangement, i.e., a region wider than the belt-like region R by a length corresponding to 600 dpi. That is, a point O is at any of the center of a straight line extending between the nozzles (1) and (16); the center of a straight line extending between the nozzles (2) and 15); the center of a straight line extending between the nozzles (3) and (14); the center of a straight line extending between the nozzles (4) and (13); the center of a straight line extending between the nozzles (5) and (12); the center of a straight line extending between the nozzles (6) and (11); the center of a straight line extending between the nozzles (7) and (10); and the center of a straight line extending between the nozzles (8) and (9). Therefore, as shown in FIG. 8, four nozzle groups 51 each constituted by sixteen nozzle rows 52 can be arranged so that the rows of all nozzle groups 51 are parallel to each other in a state wherein neighboring nozzle groups 51 have been rotated by 180 degrees relatively to each other. This makes it easy to design the nozzle plate 30 on which the trapezoidal nozzle groups 51 are formed as in this embodiment.

Figure 12:
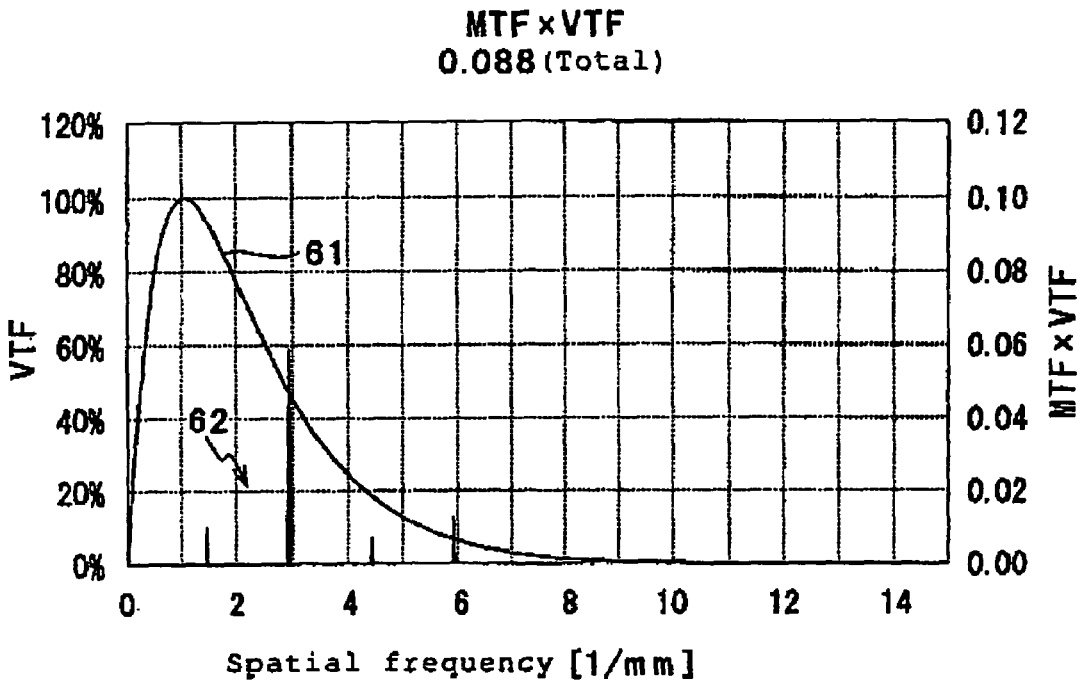
FIG. 12 is a graph showing a curve representing a visual transfer function (VTF) and a curve representing the product (MTF multiplied by VTF) of the visual transfer function and a modulation transfer function (MTF) in relation to the nozzle arrangement shown in FIG. 10.

FIG. 12 shows a graph of a visual transfer function (VTF) as a function representing a relation of the sensitivity of human visual recognition to spatial frequency determined on the basis of intervals of appearance of banding, and. A curve 61 representing the visual transfer function in FIG. 12 was obtained by an equation:

$$VTF=5.05\times\exp(-0.138\times x\times f\times\pi/180)\times(1-\exp(-0.1\times x\times f\times\pi/180))$$

where x represents an observation distance and f represents spatial frequency.

In the visual transfer function of FIG. 12, the sensitivity is the maximum when the spatial frequency is about 1/mm. That is, banding is the most conspicuous when the spatial frequency is about 1/mm. As the spatial frequency decreases or increases from 1/mm, the sensitivity of visual recognition reduces and banding becomes harder to be conspicuous.

FIG. 12 further shows a curve 62 representing the product (MTF multiplied by VTF) of the visual transfer function and a modulation transfer function (MTF) defined by the nozzle arrangement shown in FIG. 10. As shown in FIG. 12, the MTF multiplied by VTF has peaks near 1.5/mm, 3/mm, 4.4/mm, and 5.9/mm of the spatial frequency corresponding to groups of sixteen nozzles, eight nozzles, six nozzles, and four nozzles, respectively. Of the peaks, the peak near 3/mm of the spatial frequency corresponding to the group of eight nozzles is the highest.

The inventor of the present invention has confirmed that banding or white defect having occurred on a printed matter by the inkjet head 1 is not sharply sensed by a human. That is, according to this embodiment, in using the inkjet head 1 as a line head, banding or white defect caused by the attachment of the inkjet head 1 at an incorrect angle can be hard to be conspicuous. As a result, a good printed matter can be obtained even without requiring the attachment of the inkjet head 1 with high accuracy.

Figure 21:
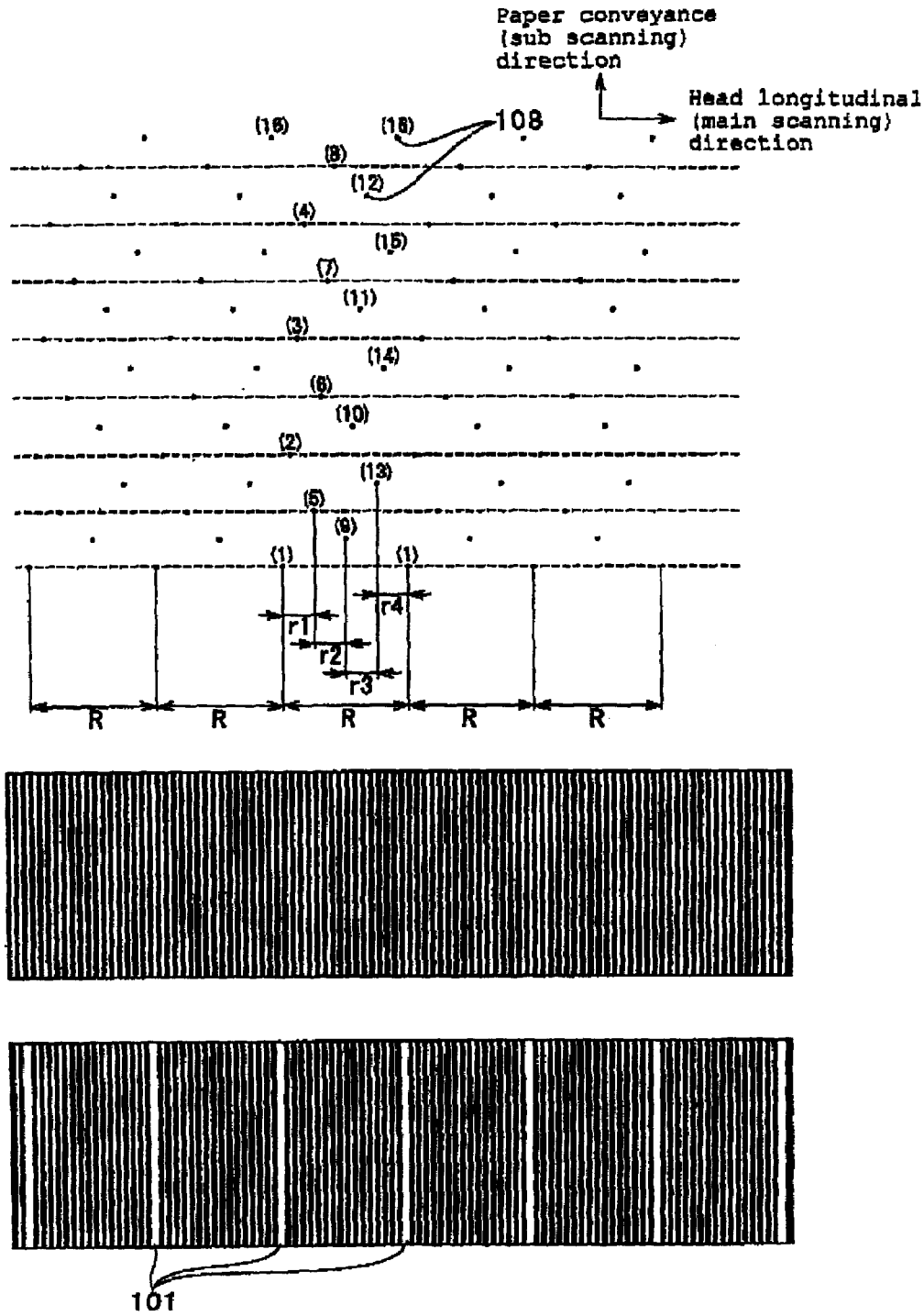
FIG. 21 are views showing an arrangement of nozzles and lines printed with the nozzles in a conventional inkjet head.

In the inkjet head 1 of this embodiment, the total of the values of the MTF multiplied by VTF at the four peaks is 0.088. Contrastingly, the total value of the MTF multiplied by VTF in the case of the nozzle arrangement of FIG. 21 is 0.110. In the latter case, banding or white defect is conspicuous. As a result of experiments by the inventor of the present invention, it has been confirmed that banding or white defect is inconspicuous when the total value of the MTF multiplied by VTF is not more than 0.10. The smaller the total value of the MTF multiplied by VTF is, the more preferable it is.

Further, as described above, the inkjet head 1 satisfies the condition of y(1)<y(2)>y(3)<y(4)>y(5)<y(6)>y(7)<y(8)>y(9)<y(10)>y(11)<y(12)>y(13)<y(14)>y(15)<y(16), and both the conditions of y(1)<y(3)>y(5)<y(7)>y(9)<y(11)>y(13)<y(15); and of y(2)<y(4)>y(6)<y(8)>y(10)<y(12)>y(14)<y(16). It is thinkable that satisfaction of these conditions is substantially synonymous with that a nozzle distribution in which the nozzles are evenly distributed in the belt-like region has been realized. Thus, on a printed matter obtained by the inkjet head 1 of this embodiment, banding or white defect is harder to be conspicuous.

Second and Third Embodiments

Next, second and third embodiments of the present invention will be described. The constructions of inkjet heads of the second and third embodiments are substantially the same as that of the first embodiment except nozzle arrangement. In the below description, therefore, the focus is placed on difference from the first embodiment and repeated description will be omitted as much as possible. In addition, the same components as in the first embodiment are denoted by the same reference numerals as in the first embodiment, respectively, and thereby the description thereof will be omitted.

Figure 13:
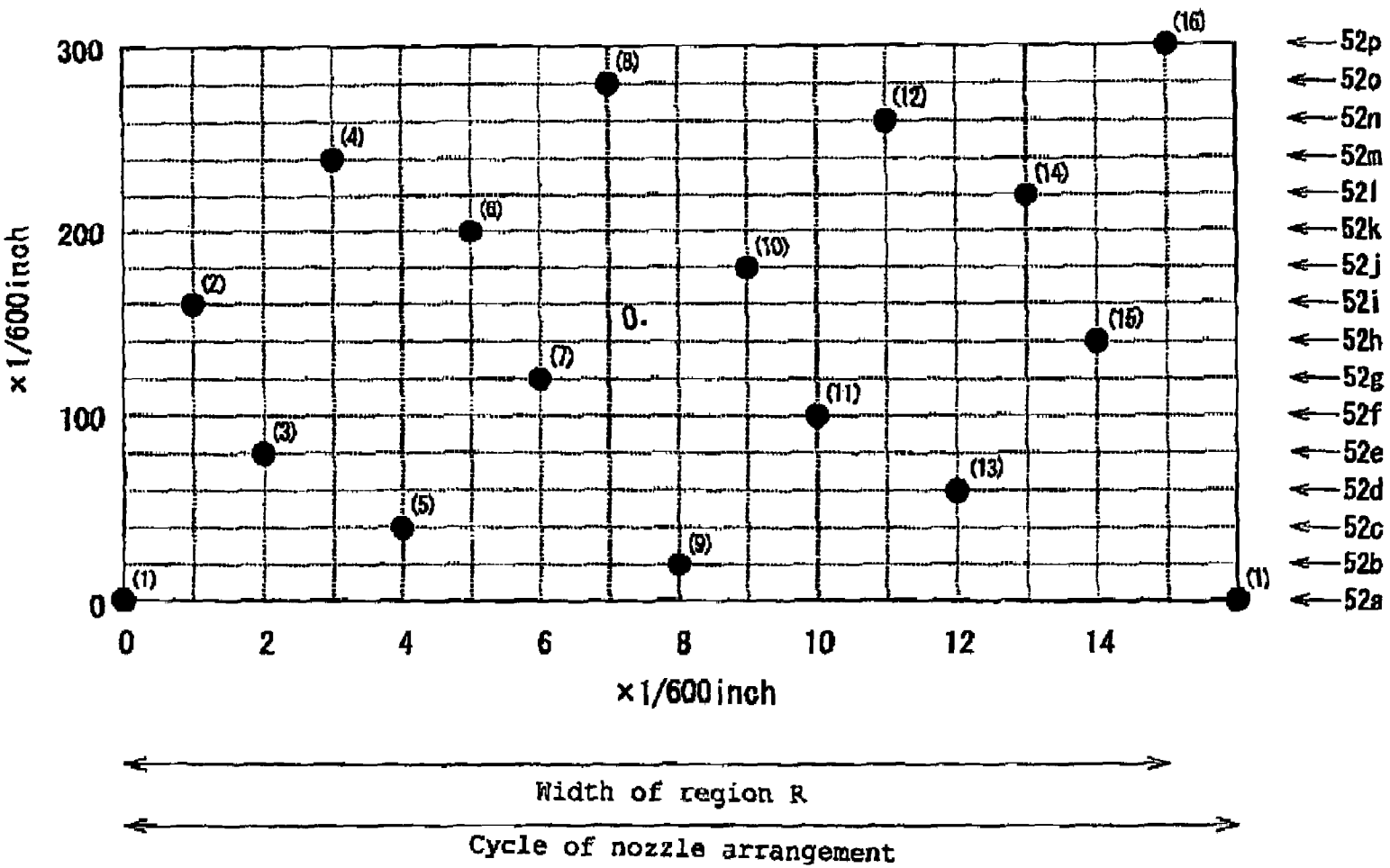
FIG. 13 is a representation showing, in an enlarged form, the positional relation of sixteen nozzles belonging to a belt-like region R in an inkjet head according to a second embodiment of the present invention.
Figure 14:
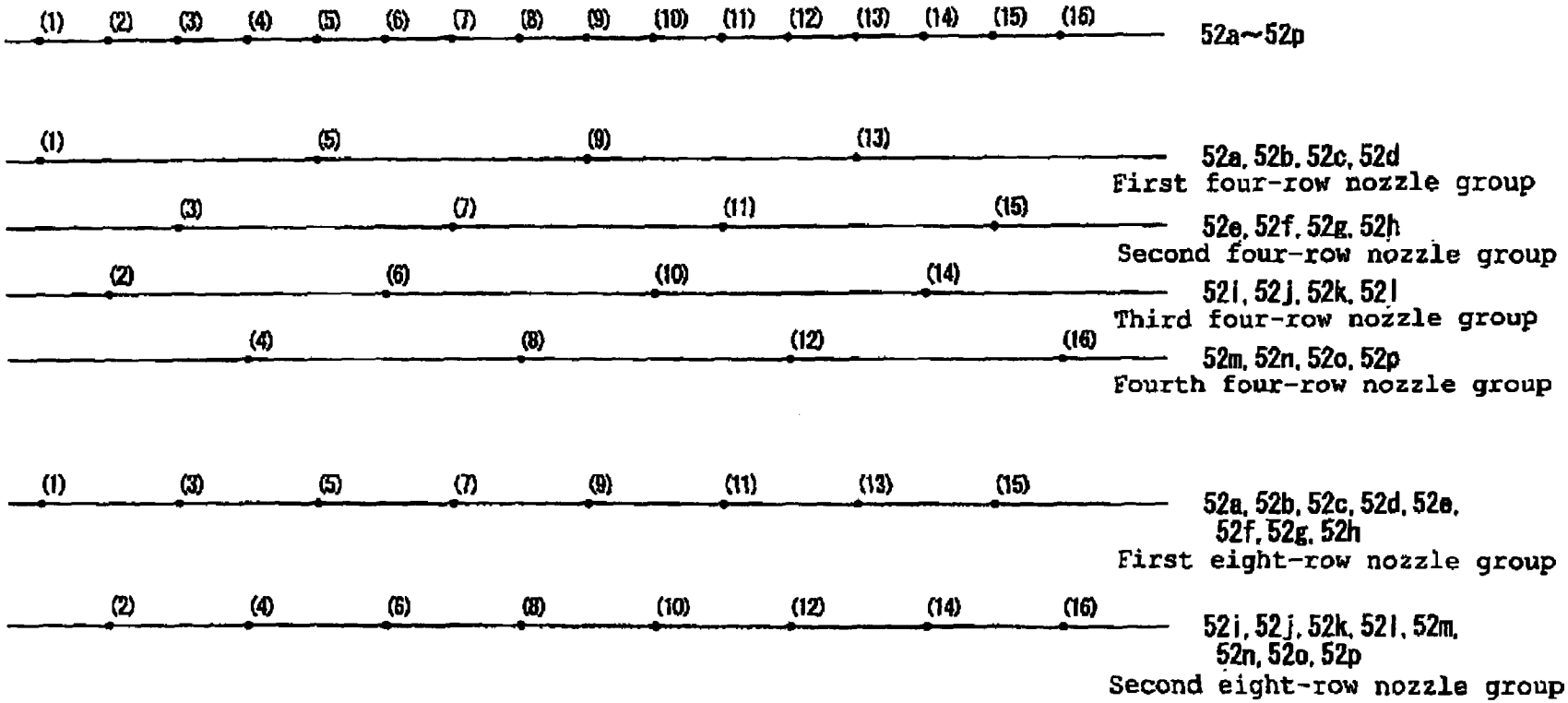
FIG. 14 is a representation showing an arrangement rule of the sixteen nozzles of FIG. 13.
Figure 16:
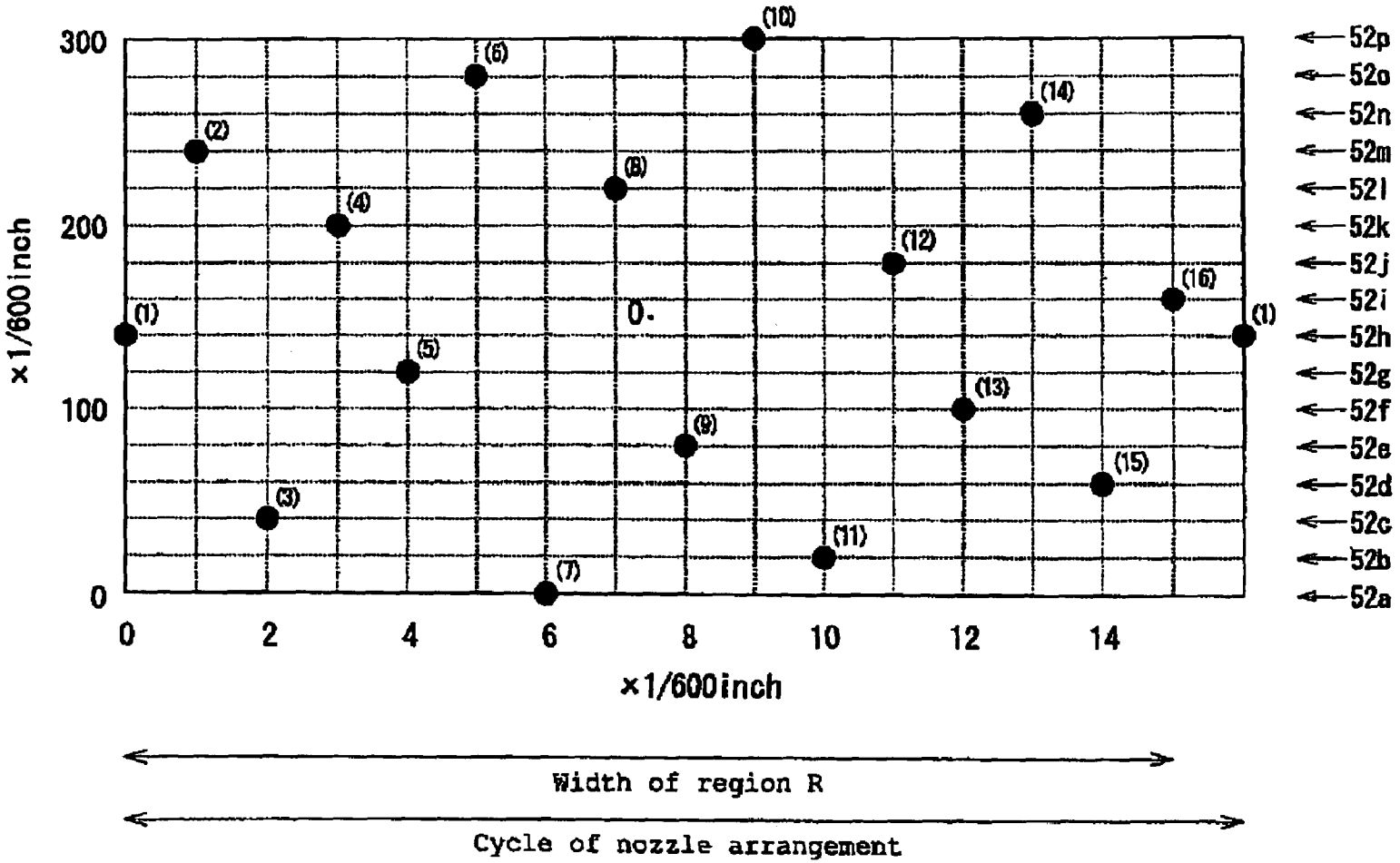
FIG. 16 is a representation showing, in an enlarged form, the positional relation of sixteen nozzles belonging to a belt-like region R in an inkjet head according to a third embodiment of the present invention.
Figure 17:
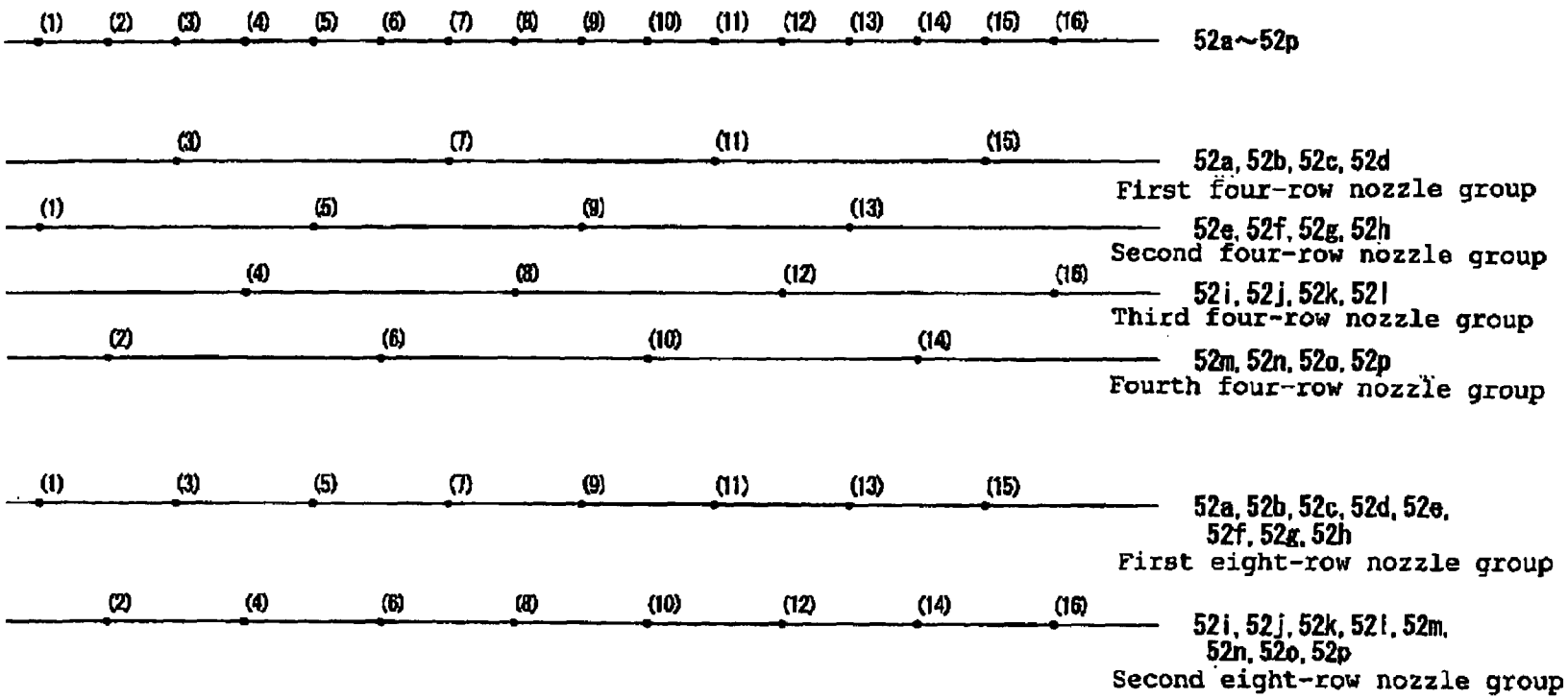
FIG. 17 is a representation showing an arrangement rule of the sixteen nozzles of FIG. 16.

FIGS. 13 and 16 show, in an enlarged form, positional relations of sixteen nozzles B belonging to one belt-like region R in inkjet heads of the second and third embodiments, respectively. FIGS. 13 and 16 correspond to FIG. 10 of the first embodiment. FIGS. 14 and 17 are for explaining arrangement rules of sixteen nozzles shown in FIGS. 13 and 16, respectively. FIGS. 14 and 17 correspond to FIG. 11 of the first embodiment. As shown in FIG. 13 or 16, when the sixteen nozzles 8 are projected on an imaginary straight line extending in the arrangement direction A, from a direction perpendicular to the arrangement direction A, the obtained projection points are arranged at intervals corresponding to a print resolution of 600 dpi, as shown in FIG. 14 or 17. Thus, when each actuator unit 21 is properly driven in accordance with conveyance of a print medium, a character, a figure, or the like, can be printed at a resolution of 600 dpi. The sixteen nozzles 8 are arranged in the direction C at regular intervals.

On the nozzle plate 30 of the inkjet head of the second or third embodiment, a large number of nozzles 8 are arranged in a cycle obtained by adding the width of the belt-like region R corresponding to 37.5 dpi, to the width of the interval between neighboring projection points, corresponding to 600 dpi. That is, even if such a belt-like region R having its left border line extending on a nozzle 8 belonging to the nozzle row 52*a* in the case of FIG. 13 or the nozzle row 52*h* in the case of FIG. 16 is set at any position in the nozzle group 51, the same pattern of nozzle arrangement is obtained in the belt-like region R.

When the sixteen nozzles 8 of FIG. 13 are numbered by (1) to (16) in order from the left, the sixteen nozzles 8 are arranged in the order of (1), (9), (5), (13), (3), (11), (7), (15), (2), (10), (6), (14), (4), (12), (8), and (16) from the lower side. On the other hand, when the sixteen nozzles 8 of FIG. 16 are numbered by (1) to (16) in order from the left, the sixteen nozzles 8 are arranged in the order of (7), (11), (3), (15), (9), (13), (5), (1), (16), (12), (4), (6), (2), (14), (6), and (10) from the lower side.

As is understood from FIG. 13 or 16, the sixteen nozzles 8 are arranged zigzag in the arrangement direction A. More specifically, when the coordinate value of each nozzle 8 in the direction C is represented by yi where i is a number for specifying each nozzle 8 and one of (1) to (16) in the present case, there is satisfied a condition of y(1)<y(2)>y(3)<y(4)>y(5)<y(6)>y(7)<y(B)>y(9)<y(10)>y(11)<y(12)>y(13)<y(14)>y(15)<y(16).

In addition, when only nozzles 8 in odd or even numbers are taken out of the sixteen nozzles 8, they also form a zigzag arrangement in the arrangement direction A. More specifically, there are satisfied both the conditions of y(1)<y(3)>y(5)<y(7)>y(9)<y(11)>y(13)<y(15); and of y(2)<y(4)>y(6)<y(8)>y(10)<y(12)>y(14)<y(16).

In the inkjet head of the second or third embodiment, differently from the first embodiment, any nozzle 8 belonging to four nozzle rows 52*a*, 52*b*, 52*c*, and 52*d* is connected to a common sub manifold flow passage 5*a*. Any nozzle 8 belonging to four nozzle rows 52*e*, 52*f*, 52*g*, and 52*h* is connected to a common sub manifold flow passage 5*a* neighboring on the lower side of the sub manifold flow passage 5*a* to which the nozzles 8 belonging to the four nozzle rows 52*a*, 52*b*, 52*c*, and 52*d* are connected. Any nozzle 8 belonging to four nozzle rows 52*i*, 52*j*, 52*k*, and 52*l* is connected to a common sub manifold flow passage 5*a* neighboring on the lower side of the sub manifold flow passage 5*a* to which the nozzles 8 belonging to the four nozzle rows 52*e*, 52*f*, 52*g*, and 52*h* are connected. Any nozzle 8 belonging to four nozzle rows 52*m*, 52*n*, 52*o*, and 52*p* is connected to a common sub manifold flow passage 5*a* neighboring on the lower side of the sub manifold flow passage 5*a* to which the nozzles 8 belonging to the four nozzle rows 52*i*, 52*j*, 52*k*, and 52*l* are connected.

Therefore, in the case of a manifold design in which inks of different colors flow in the respective sub manifold flow passages 5*a*, the sixteen nozzle rows 52*a* to 52*p* can be divided into four groups each constituted by four nozzle rows 52 that eject ink of the same color, each of which groups will be referred to as a four-row nozzle group. More specifically, the sixteen nozzle rows 52*a* to 52*p* can be divided into a group constituted by four nozzle rows 52*a*, 52*b*, 52*c*, and 52*d*, which group will be referred to as a first four-row group; a group constituted by four nozzle rows 52*e*, 52*f*, 52*g*, and 52*h*, which group will be referred to as a second four-row group; a group constituted by four nozzle rows 52*i*, 52*j*, 52*k*, and 52*l*, which group will be referred to as a third four-row group; and a group constituted by four nozzle rows 52*m*, 52*n*, 52*o*, and 52*p*, which group will be referred to as a fourth four-row group.

In FIG. 13, when four nozzles (1), (5), (9), and (13) belonging to the first four-row nozzle group of the sixteen nozzles 8 belonging to the belt-like region R are projected on an imaginary straight line extending in the arrangement direction A, from a direction perpendicular to the arrangement direction A, as shown in FIG. 14, the projection points of the four nozzles are arranged at intervals corresponding to 150 dpi. Likewise, when four nozzles (3), (7), (11), and (15) belonging to the second four-row nozzle group, four nozzles (2), (6), (10), and (14) belonging to the third four-row nozzle group, and four nozzles (4), (8), (12), and (16) belonging to the fourth four-row nozzle group, are projected on the imaginary straight line extending in the arrangement direction A, from the direction perpendicular to the arrangement direction A, any group of the projection points are also arranged at intervals corresponding to 150 dpi.

In addition, between each pair of neighboring projection points of nozzles 8 belonging to any four-row nozzle group, there is one projection point of a nozzle 8 belonging to each of the other four-row groups. More specifically, between neighboring projection points of the nozzles (5) and (9) belonging to the first four-row group, there are the projection point of the nozzle (7) belonging to the second four-row group, the projection point of the nozzle (6) belonging to the third four-row group, and the projection point of the nozzle (8) belonging to the fourth four-row group. As another example, between neighboring projection points of the nozzles (10) and (14) belonging to the third four-row group, there are the projection point of the nozzle (13) belonging to the first four-row group, the projection point of the nozzle (11) belonging to the second four-row group, and the projection point of the nozzle (12) belonging to the fourth four-row group.

On the other hand, in the case of FIG. 16, when four nozzles (3), (7), (11), and (15) belonging to the first four-row nozzle group of the sixteen nozzles 8 belonging to the belt-like region R are projected on an imaginary straight line extending in the arrangement direction A, from a direction perpendicular to the arrangement direction A, as shown in FIG. 14, the projection points of the four nozzles are arranged at intervals corresponding to 150 dpi. Likewise, when four nozzles (1), (5), (9), and (13) belonging to the second four-row nozzle group, four nozzles (4), (8), (12), and (16) belonging to the third four-row nozzle group, and four nozzles (2), (6), (10), and (14) belonging to the fourth four-row nozzle group, are projected on the imaginary straight line extending in the arrangement direction A, from the direction perpendicular to the arrangement direction A, any group of the projection points are also arranged at intervals corresponding to 150 dpi.

In addition, between each pair of neighboring projection points of nozzles 8 belonging to any four-row nozzle group, there is one projection point of a nozzle 8 belonging to each of the other four-row groups. More specifically, between neighboring projection points of the nozzles (5) and (9) belonging to the second four-row group, there are the projection point of the nozzle (7) belonging to the first four-row group, the projection point of the nozzle (6) belonging to the third four-row group, and the projection point of the nozzle (6) belonging to the fourth four-row group. As another example, between neighboring projection points of the nozzles (10) and (14) belonging to the fourth four-row group, there are the projection point of the nozzle (11) belonging to the first four-row group, the projection point of the nozzle (13) belonging to the second four-row group, and the projection point of the nozzle (12) belonging to the third four-row group.

Because four four-row nozzle groups of the first to fourth four-row nozzle groups have such a character, the inkjet head of the second or third embodiment can cope with not only monochrome printing but also four-color printing.

Further, in the case of a manifold design in which inks of different colors flow in the respective pairs of neighboring sub manifold flow passages 5*a*, in either case of FIGS. 13 and 16, the sixteen nozzle rows 52*a* to 52*p* can be divided into two eight-row nozzle groups each constituted by eight nozzle rows 52 that eject ink of the same color. More specifically, the sixteen nozzle rows 52*a* to 52*p* can be divided into a group constituted by eight nozzle rows 52*a*, 52*b*, 52*c*, 52*d*, 52*e*, 52*f*, 52*g*, and 52*h*, which group will be referred to as a first eight-row nozzle group; and a group constituted by eight nozzle rows 52*i*, 52*j*, 52*k*, 52*l*, 52*n*, 52*m*, 52*o*, and 52*p*, which group will be referred to as a second eight-row nozzle group.

In this case, when eight nozzles (1), (3), (5), (7), (9), (11), (13), and (15) belonging to the first eight-row nozzle group of the sixteen nozzles 8 belonging to the belt-like region R are projected on an imaginary straight line extending in the arrangement direction A, from a direction perpendicular to the arrangement direction A, as shown in FIG. 14 or 17, the projection points of the eight nozzles are arranged at intervals corresponding to 300 dpi. Likewise, when eight nozzles (2), (4), (6), (8), (10), (12), (14), and (16) belonging to the second eight-row nozzle group are projected on the imaginary straight line extending in the arrangement direction A, from the direction perpendicular to the arrangement direction A, the projection points of the eight nozzles are also arranged at intervals corresponding to 300 dpi.

In addition, between each pair of neighboring projection points of nozzles 8 belonging to any eight-row nozzle group, there is one projection point of a nozzle 8 belonging to the other eight-row nozzle group. More specifically, between neighboring projection points of the nozzles (5) and (7) belonging to the first eight-row nozzle group, there is the projection point of the nozzle (6) belonging to the second eight-row nozzle group. As another example, between neighboring projection points of the nozzles (10) and (12) belonging to the second eight-row nozzle group, there is the projection point of the nozzle (11) belonging to the first eight-row nozzle group.

Because two groups of the first and second eight-row nozzle groups have such a character, the inkjet head 1 of the second or third embodiment can cope with two-color printing in addition to monochrome printing and four-color printing.

As is understood from FIG. 13 or 16, sixteen nozzles 8 are arranged symmetrically about a point within the belt-like region R or a region corresponding to one cycle of nozzle arrangement, i.e., a region wider than the belt-like region R by a length corresponding to 600 dpi. That is, a point O is at any of the center of a straight line extending between the nozzles (1) and (16); the center of a straight line extending between the nozzles (2) and 15); the center of a straight line extending between the nozzles (3) and (14); the center of a straight line extending between the nozzles (4) and (13); the center of a straight line extending between the nozzles (5) and (12); the center of a straight line extending between the nozzles (6) and (11); the center of a straight line extending between the nozzles (7) and (10); and the center of a straight line extending between the nozzles (8) and (9). Therefore, as shown in FIG. 8, four nozzle groups 51 each constituted by sixteen nozzle rows 52 can be arranged so that the rows of all nozzle groups 51 are parallel to each other in a state wherein neighboring nozzle groups 51 have been rotated by 180 degrees relatively to each other. This makes it easy to design the nozzle plate 30 on which the trapezoidal nozzle groups 51 are formed as in the second or third embodiment.

Figure 15:
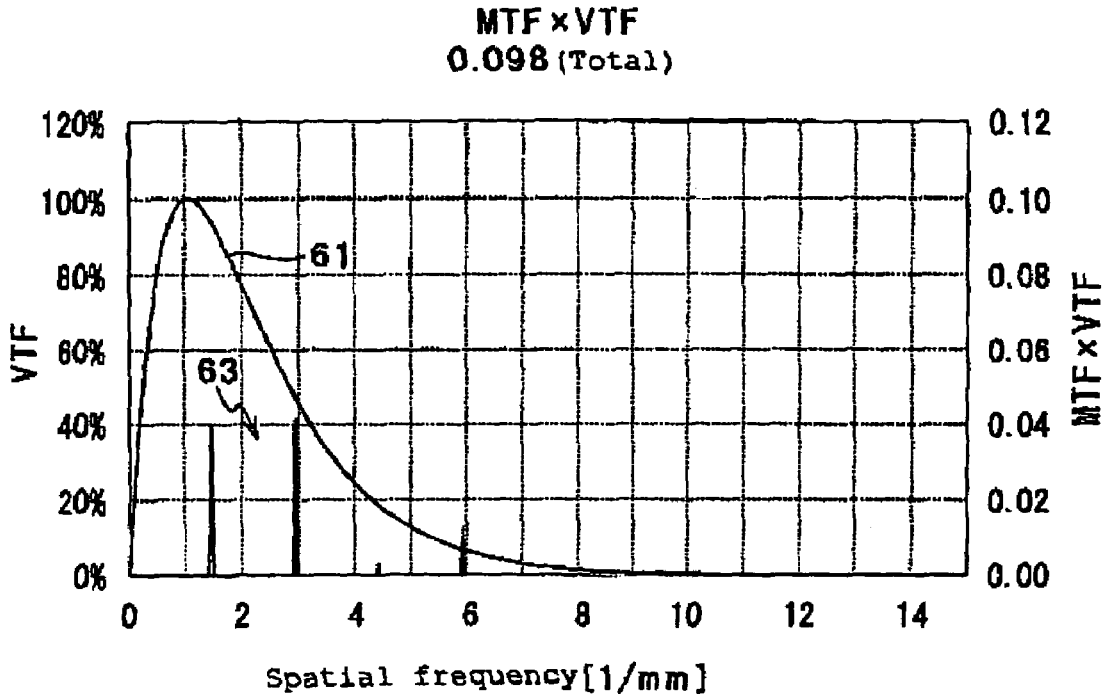
FIG. 15 is a graph showing a curve representing a visual transfer function (VTF) and curves representing the product (MTF multiplied by VTF) of the visual transfer function and a modulation transfer function (MTF) in relation to the nozzle arrangement shown in FIG. 13.

FIG. 15 shows a curve 61 representing the same visual transfer function as in FIG. 12, and a curve 63 representing the product (MTF multiplied by VTF) of the visual transfer function and a modulation transfer function (MTF) defined by the nozzle arrangement shown in FIG. 13. As shown in FIG. 15, the MTF multiplied by VTF has peaks near 1.5/mm, 3/mm, 4.4/mm, and 5.9/mm of the spatial frequency corresponding to groups of sixteen nozzles, eight nozzles, six nozzles, and four nozzles, respectively. Of the peaks, the peaks near 1.5/mm and 3/mm of the spatial frequency corresponding to the group of sixteen nozzles and eight nozzles are extremely higher than the remaining two peaks.

Figure 18:
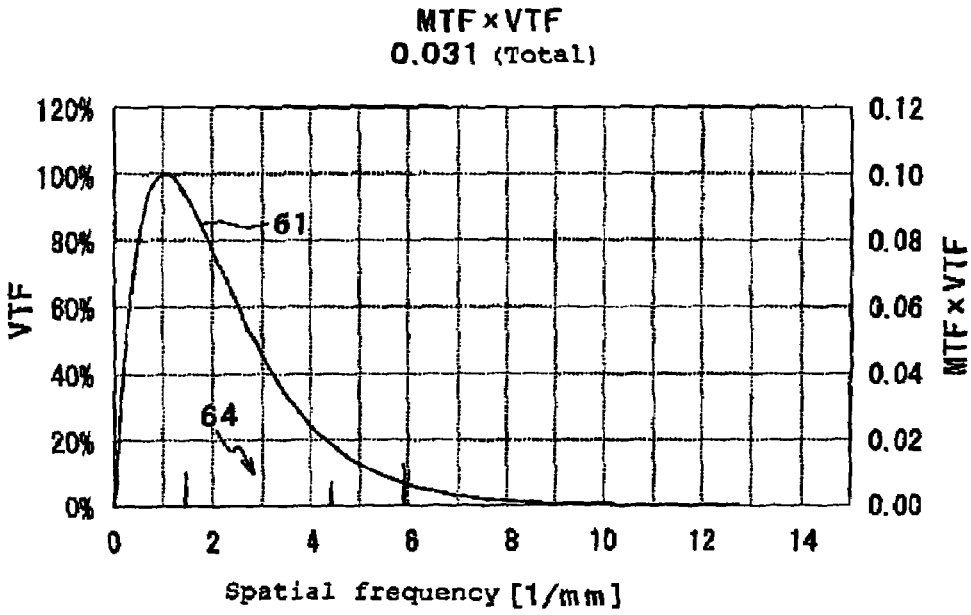
FIG. 18 is a graph showing a curve representing a visual transfer function (VTF) and curves representing the product (MTF multiplied by VTF) of the visual transfer function and a modulation transfer function (MTF) in relation to the nozzle arrangement shown in FIG. 16.

FIG. 18 shows a curve 61 representing the same visual transfer function as in FIG. 12, and a curve 64 representing the product (MTF multiplied by VTF) of the visual transfer function and a modulation transfer function (MTF) defined by the nozzle arrangement shown in FIG. 16. As shown in FIG. 18, the MTF multiplied by VTF has peaks near 1.5/mm, 4.4/mm, and 5.9/mm of the spatial frequency corresponding to groups of sixteen nozzles, six nozzles, and four nozzles, respectively.

The inventor of the present invention has confirmed that banding or white defect having occurred on a printed matter by the inkjet head of any of the second and third embodiment is not sharply sensed by a human. That is, in using an inkjet head having the nozzle arrangement shown in FIG. 13 or 16 as a line head, banding or white defect caused by the attachment of the inkjet head at an incorrect angle can be hard to be conspicuous. As a result, a good printed matter can be obtained even without requiring the attachment of the inkjet head with high accuracy. In the inkjet head of FIG. 13, the total of the values of the MTF multiplied by VTF at the four peaks is 0.098. On the other hand, in the inkjet head of FIG. 16, the total of the values of the MTF multiplied by VTF at the three peaks is 0.031.

Further, as described above, either of the inkjet heads of the second and third embodiments satisfies the condition of $y(1)<y(2)>y(3)<y(4)>y(5)<y(6)>y(7)<y(8)>y(9)<y(10)>y(11)<y(12)>y(13)<y(14)>y(15)<y(16)$, and both the conditions of $y(1)<y(3)>y(5)<y(7)>y(9)<y(11)>y(13)<y(15)$; and of $y(2)<y(4)>y(6)<y(8)>y(10)<y(12)>y(14)<y(16)$. It is thinkable that satisfaction of these conditions is substantially synonymous with that a nozzle distribution in which the nozzles are evenly distributed in the belt-like region has been realized. Thus, on a printed matter obtained by either of the inkjet heads of the second and third embodiments, banding or white defect is harder to be conspicuous.

Other Embodiments

Figure 19:
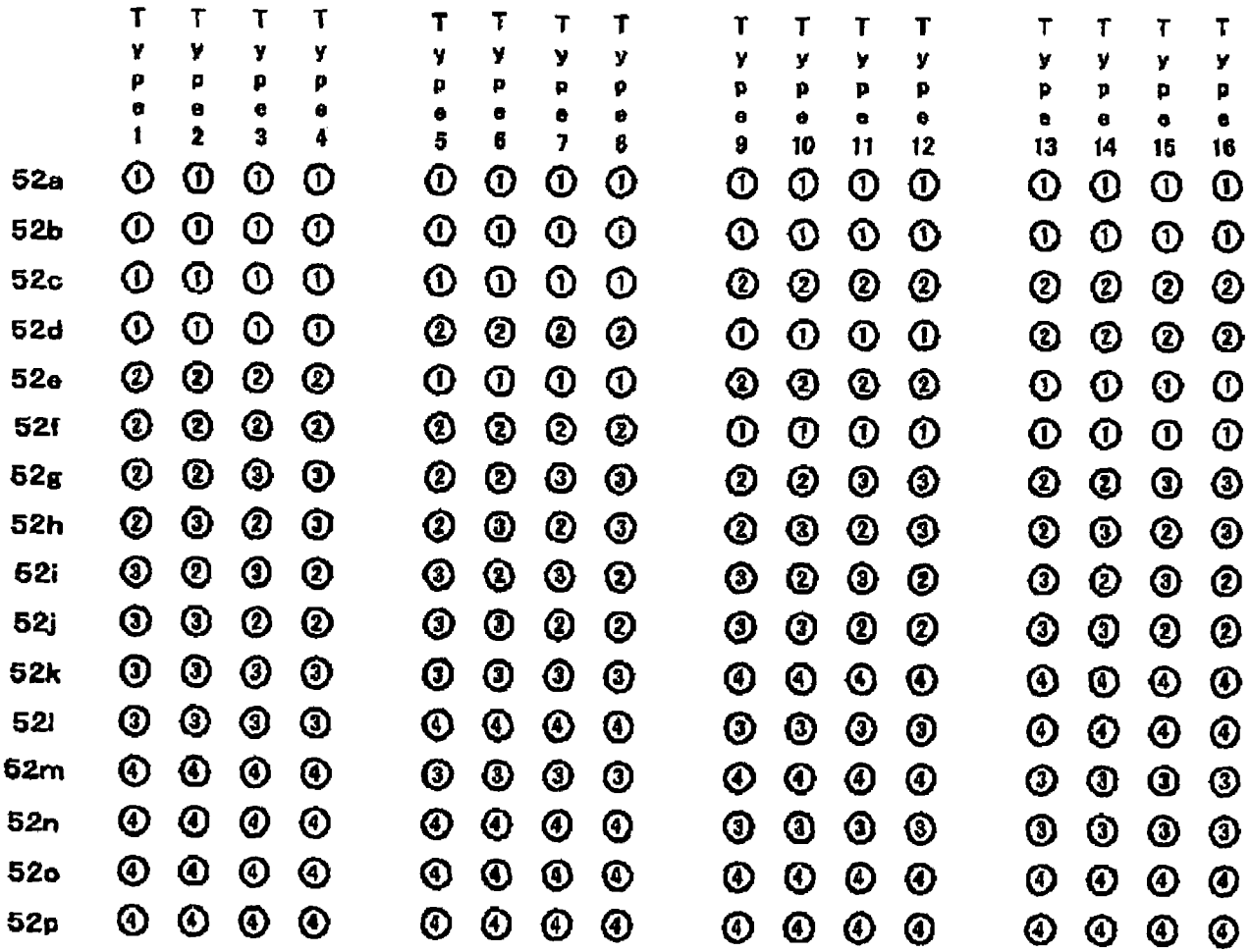
FIG. 19 is a representation showing variations of arrangement of sixteen nozzle rows when the sixteen nozzle rows are divided into first to fourth four-row nozzle groups.

Next, embodiments other than the above-described first to third embodiments will be described. FIG. 19 shows variations of arrangement of sixteen nozzle rows when the sixteen nozzle rows are divided into first to fourth four-row nozzle groups as described above. In FIG. 19, nozzles belonging to the first to fourth four-row nozzle groups are represented by (1), (2), (3), and (4), respectively. If the sixteen nozzle rows of FIG. 19 are divided into two eight-row nozzle groups, nozzles represented by (1) or (2) belong to a first eight-row nozzle group and nozzles represented by (3) or (4) belong to a second eight-row nozzle group.

FIG. 19 shows sixteen arrangement variations from type 1 to type 16. Of the types, the type 6 corresponds to the first embodiment of FIG. 10 and the type 1 corresponds to the second and third embodiments of FIGS. 13 and 16. In any of the sixteen arrangement variations from the type 1 to the type 16 of FIG. 19, outside the outermost row of each four-row nozzle group, there are two or more nozzle rows belonging to another four-row nozzle group neighboring that four-row nozzle group. In addition, inside the outermost row of each four-row nozzle group, there is no nozzle row belonging to a four-row nozzle group not neighboring that four-row nozzle group. On the other hand, in the case that the sixteen nozzle rows are divided into the first and second eight-row nozzle groups as described above, in any of the sixteen arrangement variations from the type 1 to the type 16 of FIG. 19, outside the outermost row of each eight-row nozzle group, there are six or more nozzle rows belonging to the other eight-row nozzle group neighboring that eight-row nozzle group.

Further, each type shown in FIG. 19 has a degree of freedom in what pattern four nozzles belonging to the respective first to fourth four-row nozzle groups are arranged. By taking conditions for making it possible to cope with four-color printing and two-color printing as described above, into consideration, as the degree of freedom, there are forty-eight kinds obtained by 4! (the number of nozzles in each group) multiplied by 4 (the number of groups)/2 (symmetry). FIG. 20 shows the forty-eight kinds of nozzle arrangement patterns. Of the arrangement patterns, the third arrangement pattern from the left corresponds to FIGS. 10 and 13 and the tenth arrangement pattern from the right corresponds to FIG. 16. But, in the case of FIG. 10, two nozzles on the border lines between four-row nozzle groups are exchanged in position. This is because FIG. 10 corresponds to the type 6 shown in FIG. 19.

Any of the forty-eight patterns of FIG. 20 satisfies some of the same nozzle arrangement conditions as those described in the first embodiment, that is: (a) the projection points are arranged at regular intervals; (b) nozzles are arranged zigzag in the arrangement direction A in any case of all the sixteen nozzles, only the nozzles in odd numbers, and only the nozzles in even numbers; and (c) even when the nozzle arrangement of each of the forty-eight patterns is divided into groups for the respective colors as in FIG. 19, in either of the cases that each group includes two nozzle rows and the each group includes four nozzle rows, like the first embodiment, the projection points of nozzles belonging to each group are arranged at regular intervals common to all groups, and between neighboring projection points of nozzles belonging to each group, there is one projection point of nozzle belonging to each of the other groups. In addition, in one cycle of each nozzle arrangement, the sixteen nozzles can be arranged symmetrically about a point.

Of the above-described conditions (a) to (c), each pattern of FIG. 20 satisfies the condition (a) and at least one of the conditions (b) and (c). Any of the nozzle arrangement patterns satisfying the conditions (a) and (b) and the nozzle arrangement patterns satisfying the conditions (a) and (c) realizes a nozzle distribution in which nozzles are evenly distributed in the belt-like region R. Therefore, in an inkjet head in which nozzles are arranged in any of the forty-eight patterns of FIG. 20, the total value of the MTF multiplied by VTF is relatively small, and banding or white defect is hard to be conspicuous on a printed matter obtained by such an inkjet head. Thus, an inkjet head having a nozzle arrangement pattern satisfying the conditions (a) and (b) and an inkjet head having a nozzle arrangement pattern satisfying the conditions (a) and (c) are effective for preventing banding and white defect.

In the above-described embodiments, the shape or the like of each flow passage or each pressure chamber may be adequately changed. The number of nozzles included in each group may be arbitrarily changed. The total number of nozzle rows may be any value other than sixteen as far as the value is a multiple of four.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet head comprising:

a plurality of nozzles for ejecting ink arranged on an ink ejection face of the inkjet head in 4n rows (n: a natural number) extending parallel to each other in one direction such that projection points of the nozzles obtained by projecting all the nozzles constituting the 4n rows on an imaginary straight line extending in the one direction, from a direction parallel to a plane including therein the 4n rows, and perpendicular to each row, are arranged on the imaginary straight line at regular intervals, the plurality of nozzles being arranged in a cycle corresponding to a distance between the projection points at both ends of 4n+1 projection points arranged on the imaginary straight line;

the total of products each obtained by a peak value of a modulation transfer function defined by the arrangement of the plurality of nozzles, multiplied by a value of a visual transfer function at a spatial frequency corresponding to the peak value of the modulation transfer function, being not more than 0.10.

2. The inkj et head according to claim 1, wherein, when $y_i$ (i: a natural number) represents a coordinate value, in a direction perpendicular to the one direction, of the nozzle corresponding to the i-th projection point on the imaginary straight line, one of conditions that the coordinate value $y_{i+2}$, in the direction perpendicular to the one direction, of the nozzle corresponding to the (i+1)th projection point is larger than $y_i$ and the coordinate value $y_{i+2}$, in the direction perpendicular to the one direction, of the nozzle corresponding to the (i+2)th projection point is smaller than $y_{i+1}$, and that the coordinate value $y_{+1}$, in the direction perpendicular to the one direction, of the nozzle corresponding to the (i+1)th projection point is smaller than $y_i$ and the coordinate value $y_{i+2}$, in the direction perpendicular to the one direction, of the nozzle corresponding to the (i+2)th projection point is larger than $y_{i+1}$, is satisfied for any value of i.

3. The inkjet head according to claim 2, wherein one of conditions that the coordinate value $y_{i+2}$, in the direction perpendicular to the one direction, of the nozzle corresponding to the (i+2)th projection point is larger than $y_i$ and the coordinate value $y_{i+4}$, in the direction perpendicular to the one direction, of the nozzle corresponding to the (i+4)th projection point is smaller than $y_{i+2}$, and that the coordinate value $y_{i+2}$, in the direction perpendicular to the one direction, of the nozzle corresponding to the (i+2)th projection point is smaller than $y_i$ and the coordinate value $y_{i+4}$, in the direction perpendicular to the one direction, of the nozzle corresponding to the (i+4)th projection point is larger than $y_{i+2}$, is satisfied for any value of i.

4. The inkjet head according to claim 1, wherein, when the 4n rows are divided into four groups each constituted by n rows close to each other such that there are not less than n/2 rows belonging to a neighboring row group outside the outermost row of each group and there is no row belonging to a non-neighboring row group inside the outermost row of each group, the projection points of the nozzles belonging to each group are arranged on the imaginary straight line at regular intervals common to all the groups, and the interval between any pair of neighboring projection points of nozzles belonging to each group includes therein one projection point of a nozzle belonging to each of the other groups.

5. The inkjet head according to claim 4, wherein, when the 4n rows are divided into two groups each constituted by 2n rows close to each other such that there are not less than 3n/2 rows belonging to the neighboring row group outside the outermost row of each group, the projection points of the nozzles belonging to each group are arranged on the imaginary straight line at regular intervals common to both groups, and the interval between any pair of neighboring projection points of nozzles belonging to each group includes therein one projection point of a nozzle belonging to the other group.

6. The inkjet head according to claim 1, wherein the plurality of nozzles are arranged symmetrically about a point in a region defined by two imaginary straight lines perpendicular to the one direction and distant from each other by a distance corresponding to one cycle of the arrangement of the plurality of nozzles.

7. An inkjet head comprising:

a plurality of nozzles for ejecting ink arranged on an ink ejection face of the inkj et head in a plurality of rows extending parallel to each other in one direction such that projection points of the nozzles obtained by projecting all the nozzles constituting the plurality of rows on an imaginary straight line extending in the one direction, from a direction parallel to a plane including therein the plurality of rows, and perpendicular to each row, are arranged on the imaginary straight line at regular intervals;

when $y_i$ (i: a natural number) represents a coordinate value, in a direction perpendicular to the one direction, of the nozzle corresponding to the i-th projection point on the imaginary straight line, one of conditions that the coordinate value $y_{i+1}$, in the direction perpendicular to the one direction, of the nozzle corresponding to the (i+1)th projection point is larger than $y_i$ and the coordinate value $y_{i+2}$ in the direction perpendicular to the one direction, of the nozzle corresponding to the (i+2)th projection point is smaller than $y_{i+1}$, and that the coordinate value $y_{i+1}$, in the direction perpendicular to the one direction, of the nozzle corresponding to the (i+1)th projection point is smaller than yj and the coordinate value $y_{i+2}$, in the direction perpendicular to the one direction, of the nozzle corresponding to the (i+2)th projection point is larger than $y_{i+1}$, being satisfied for any value of i; and one of conditions that the coordinate value $y_{i+2}$, in the direction perpendicular to the one direction, of the nozzle corresponding to the (i+2)th projection point is larger than $y_i$ and the coordinate value $y_{i+4}$, in the direction perpendicular to the one direction, of the nozzle corresponding to the (i+4)th projection point is smaller than $y_{i+2}$, and that the coordinate value $y_{i+2}$, in the direction perpendicular to the one direction, of the nozzle corresponding to the (i+2)th projection point is smaller than $y_i$ and the coordinate value $y_{i+4}$, in the direction perpendicular to the one direction, of the nozzle corresponding to the (i+4)th projection point is larger than $y_{i+2}$, being satisfied for any value of i, all of the plurality of nozzles of one cycle being arranged symmetrically about a point in a region defined by two imaginary straight lines perpendicular to the one direction and distant from each other by a distance corresponding to the one cycle of the arrangement of the plurality of nozzles.

8. An inkjet head comprising:

a plurality of nozzles for ejecting ink arranged on an ink ejection face of the inkjet head in 4n rows (n: a natural number) extending parallel to each other in one direction such that projection points of the nozzles obtained by projecting all the nozzles constituting the 4n rows on an imaginary straight line extending in the one direction, from a direction parallel to a plane including therein the 4n rows, and perpendicular to each row, are arranged on the imaginary straight line at regular intervals, the plurality of nozzles being arranged in a cycle corresponding to a distance between the projection points at both ends of 4n+1 projection points arranged on the imaginary straight line;

when the 4n rows are divided into four groups each constituted by n rows close to each other such that there are not less than n/2 rows belonging to a neighboring row group outside the outermost row of each group and there is no row belonging to a non-neighboring row group inside the outermost row of each group, the projection points of the nozzles belonging to each group, being arranged on the imaginary straight line at regular intervals common to all the groups, and the interval between any pair of neighboring projection points of nozzles belonging to each group, including therein one projection point of a nozzle belonging to each of the other groups;

when the 4n rows are divided into two groups each constituted by 2n rows close to each other such that there are not less than 3n/2 rows belonging to the neighboring row group outside the outermost row of each group, the projection points of the nozzles belonging to each group, being arranged on the imaginary straight line at regular intervals common to both groups, and the interval between any pair of neighboring projection points of nozzles belonging to each group, including therein one projection point of a nozzle belonging to the other group; and all of the plurality of nozzles of one cycle being arranged symmetrically about a point in a region defined by two imaginary straight lines perpendicular to the one direction and distant from each other by a distance corresponding to the one cycle of the arrangement of the plurality of nozzles.

* * * * *

UNITED STATES PATENT AND TRADEMARK OFFICE

CERTIFICATE OF CORRECTION

PATENT NO. : 7,354,136 B2
APPLICATION NO. : 11/090641
DATED : April 8, 2008
INVENTOR(S) : Tatsuo Oishi It is certified that error appears in the above-identified patent and that said Letters Patent is hereby corrected as shown below:

Title Page; should read;

Please correct the Assignee as follows:

(73) Brother Kogyo Kabushiki Kaisha

Signed and Sealed this

Fifteenth Day of July, 2008

JON W. DUDAS
*Director of the United States Patent and Trademark Office*